US005309993A

United States Patent [19]

Coon et al.

[11] Patent Number: 5,309,993

[45] Date of Patent: May 10, 1994

[54] CHEVRON SEAL FOR A WELL TOOL

[75] Inventors: Robert J. Coon; Steve Jennings, both of Houston; Mark E. Hopmann, Alvin, all of Tex.

[73] Assignee: Baker Hughes Incorporated, Houston, Tex.

[21] Appl. No.: 832,928

[22] Filed: Feb. 10, 1992

Related U.S. Application Data

[63] Continuation-in-part of Ser. No. 573,581, Aug. 27, 1990, Pat. No. 5,156,220, and a continuation-in-part of Ser. No. 751,350, Apr. 28, 1991.

[51] Int. Cl.[5] ..... E21B 33/10; F16J 15/16

[52] U.S. Cl. ..... 166/115; 166/141; 166/242; 277/125; 277/DIG. 3

[58] Field of Search ..... 166/141, 242, 115, 116; 277/123, 124, 125, DIG. 3

[56] References Cited

U.S. PATENT DOCUMENTS

| | | | |
|---|---|---|---|
| 3,351,350 | 11/1967 | Shepler . | |
| 3,467,394 | 9/1969 | Bryant . | |
| 3,627,337 | 12/1971 | Pippert | 277/233 |
| 4,050,701 | 9/1977 | Webb | 277/125 |
| 4,234,197 | 11/1980 | Amancharla | 277/124 |
| 4,406,469 | 9/1983 | Allison | 277/123 |
| 4,415,169 | 11/1983 | Kim | 277/125 |
| 5,131,666 | 7/1992 | Hutchens | 277/125 X |

*Primary Examiner*—Terry Lee Melius

*Attorney, Agent, or Firm*—Melvin A. Hunn; Mark W. Handley

[57] ABSTRACT

A sealing apparatus is provided for sealing between concentric relatively moveable tubular members. The sealing apparatus is comprised of a plurality of retainer seal rings, made of a high temperature thermoplastic, and between each retainer seal ring is a thermoplastic seal ring constructed of a normal temperature service thermoplastic. The thermoplastic seal rings are alternately spaced with the high temperature thermoplastic retainer seal rings. The retainer seal rings and the thermoplastic seal rings are cylindrical rings having a radial cross-section of a general chevron shape. Energization to press both sets of seals into sealing engagement with the two relatively moveable tubular members is accomplished by the interaction of an axial interference fit between alternating seal rings, a diametrical interference fit between the relatively moveable wellbore surfaces and the seal rings, and wellbore fluid pressure. Wellbore fluid pressure pushes against the female portion of the general chevron shape to flare outward the retainer seal rings into sealing engagement with the relatively moveable tubular members. At higher wellbore temperatures, the retainer seal rings, which are alternated every other one with the thermoplastic seal rings, maintain the shape of the thermoplastic seal rings so that they will sealingly engage the relatively moveable members when the seal assembly is cooled from higher wellbore temperatures to lower wellbore temperatures.

31 Claims, 18 Drawing Sheets

CHEVRON SEAL FOR A WELL TOOL

CROSS-REFERENCE TO RELATED APPLICATION

This application is a continuation-in-part of the earlier application Ser. No. 07/573,581, filed Aug. 27, 1990, now U.S. Pat. No. 5,156,220 and Ser. No. 07/751,350 Filed Apr. 28, 1991, both entitled *Well Tool With Sealing Means.*

BACKGROUND OF THE INVENTION

1. Technical Field

This invention relates to a seal system design for use in the completion and production operations of oil and gas wells wherein the seal is comprised of a plurality of plastically deformable members comprised of alternating seal rings of different materials utilized to sealing engage moveable wellbore members.

2. Description of the Related Art

Prior art sealing assemblies have been used to sealingly engaged moveable members in wellbore tools. These prior art sealing assemblies fail to perform after prolonged exposure to wellbore temperatures and pressures, some failing after minimal exposure to wellbore conditions. None of these prior art sealing assemblies reliably sealingly engaged noncontinuously mating moveable members after several mating engagements.

One example of a prior art sealing assembly would be the Conduit Sealing System of the Amancharla Patent, U.S. Pat. No. 4,234,197, disclosing a sealing assembly comprised of several types of materials. One of these materials is a perfluoroelastomer sold by DuPont under the trademark KALREZ. Although this material has high thermal stability and excellent chemical resistance, it is an elastomeric material which after prolonged exposure to wellbore temperatures will harden, become brittle, and fail to provide a dynamic sealing engagement with moveable wellbore surfaces.

Another example of a prior art sealing device is the Plastically Deformable Conduit Seal For Subterranean Wells disclosed in the Allison Patent issued as U.S. Pat. No. 4,406,469. This patent disclosed a self-energizing sealing system employing plastically deformable nonelastomeric elements to establish sealing integrity between concentric, relatively moveable tubular conduits. This prior art self-energizing sealing system, or sealing apparatus, is comprised of a plurality of sealing members including chevron-shaped thermoplastic members, and high temperature thermoplastic members made of polyphenylene sulfide resin sold under the trademark RYTON. Although RYTON members provide support to prevent extrusion of regular service temperature sealing members, they do not sealingly engage repeatably slidable moving surfaces to prevent wellbore pressures from damaging regular service temperature sealing members. In fact, testing in the development of the current invention indicated that this sealing apparatus failed to reliably perform after several actuations of a moveable member when mating between sealing elements and surfaces to be sealed was not continuous.

In addition, various prior art sealing assemblies were tested. None of these prior art sealing assemblies would perform reliably after temperature thermocycling, prolonged exposure to high temperature, and repeated actuation of noncontinuously mated moveable members for more than five cycles of actuation. Most of the prior art sealing assemblies failed to perform after one or two actuations.

SUMMARY OF THE INVENTION

It is one objective of this invention to provide a sealing apparatus used for dynamic sealing engagement with a noncontinuously mating movable member in a wellbore.

It is also an objective of this invention to provide a sealing apparatus used for dynamic sealing engagement with a ported moveable member after the port in the ported moveable member has passed over the sealing apparatus.

It is another objective of this invention to provide a wellbore sealing apparatus constructed of all thermoplastic materials for improved chemical resistance, and sealing engagement during prolonged exposure to high wellbore temperatures and after repeated temperature thermocycling.

It is another objective of this invention to provide an all thermoplastic seal which is self energizing when contained between two mating surfaces for sealing engagement and exposed to a wellbore pressure so that less durable elastomeric materials will not be required.

It is yet another objective of this invention to provide a sealing apparatus comprised of a thermoplastic material and a high temperature thermoplastic material wherein the high temperature thermoplastic material will prevent extrusion and retain the shape of the low temperature thermoplastic material for later sealing engagement with a noncontinuously mating moveable member.

These objectives are achieved as is now described. A sealing apparatus comprised of all thermoplastic sealing members is retained between two relatively movable surfaces in a wellbore tool. The sealing members are comprised of two different thermoplastic materials, one being a normal temperature surface thermoplastic used for sealingly engaging wellbore surfaces at normal wellbore temperatures, and the other being a high temperature thermoplastic used for sealingly engaging wellbore surfaces at higher wellbore temperatures. Since both materials are thermoplastic they have improved chemical resistance and a higher service temperature life than prior art sealing apparatuses made of elastomeric sealing materials. These sealing members have a cross-section which is generally chevron in shape so that adjacent sealing members are matingly engaged and are self energizing when contained within the surfaces with which they seal and compressed by a wellbore pressure. Since the sealing members are self-energizing, less durable elastomeric materials are not required. Seal members made of normal service temperature thermoplastic are alternated between seal members made of high temperature thermoplastic, with a high temperature seal member located on each side of the normal service temperature thermoplastic seal members. With the normal service temperature thermoplastic seal members sandwiched between high temperature thermoplastic seal members, at high wellbore temperatures the high temperature thermoplastic seal members will both sealingly engage the relatively moveable wellbore surfaces and also retain the shape of the normal temperature service thermoplastic seal members so that they will seal when cooled to normal wellbore temperatures.

The sealing apparatus is especially useful in providing a seal between concentric and relatively moveable tubular members. In that use, the sealing apparatus is comprised of a plurality of retainer seal rings, made of a high temperature thermoplastic, and between each retainer seal ring is a thermoplastic seal ring constructed of a normal temperature service thermoplastic so that the thermoplastic seal rings are alternately spaced with the high temperature thermoplastic retainer seal rings. The retainer seal rings and the thermoplastic seal rings are cylindrical rings having a radial cross-section of a general chevron shape. A portion of the alternating seal rings are stacked together and installed opposite another portion of the alternating seal rings which are also stacked together, then both stacks are placed in a cavity which retains the rings for sealing engagement between the two cylindrical relatively moveable wellbore surfaces. Energization to press both sets of seals into sealing engagement with the two relatively moveable tubular members is accomplished by the interaction of an axial interference fit between alternating individual rings, and a diametrical interference fit between the relatively moveable wellbore surfaces and the retainer seal rings, in combination with the wellbore fluid pressure which the rings seal against. Wellbore fluid pressure pushes against the female portion, which is inwardly protruding, of the general chevron shape to flare outward the retainer seal rings into sealing engagement with the relatively moveable tubular members. When wellbore pressure presses upon an outer retainer seal ring, the nose of that retainer seal ring is pushed into the adjoining thermoplastic plastic seal ring chevron crotch to flare the sides of the crotch outward, which pushes the sides of this thermoplastic seal ring into mating engagement with the relatively moveable tubular members. At higher temperatures, such as above 270° F. the retainer seal rings, which are alternated every other one with the thermoplastic seal rings, maintain the shape of the thermoplastic seal rings so that they will sealingly engage the relatively moveable members when the seal assembly is cooled from higher wellbore temperatures to lower wellbore temperatures.

The present invention greatly improves the service life and reliability of wellbore sealing assemblies, even those subjected to prolonged exposure at severe wellbore conditions. Testing of this new invention showed that it could be exposed to severe wellbore conditions, and it repeatedly and reliably performed in sealing engagement with noncontinuously mating moveable members for twenty-five actuation cycles, which would be fifty movements in different axial directions, and it was still capable of further sealing engagement.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
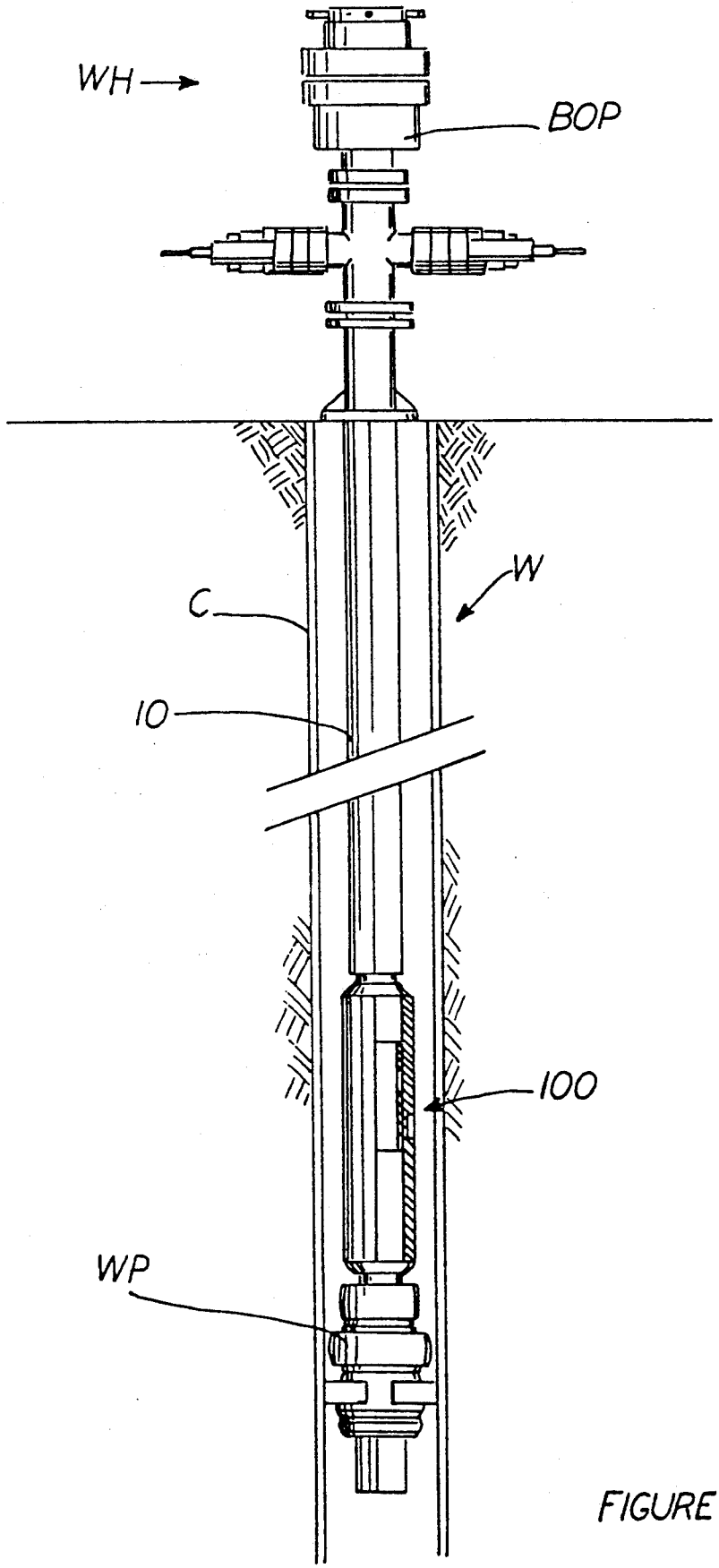
FIG. 1 is a longitudinal sectional view of a subterranean well showing the apparatus positioned above a well packer during actual production of the well.

With first reference to FIG. 1, there is schematically shown a wellbore tool in which the apparatus of the present invention maybe used in a well W with a wellhead WH positioned at the top and a blowout preventer BOP positioned thereon.

It will be appreciated that the apparatus of the present invention may be incorporated into a wellbore tool on a production string during actual production of the well in which the wellhead WH will be in the position as shown. Alternatively, the apparatus of the present invention may also be included inside a wellbore tool which is a portion of a workstring during the completion or workover operation of the well with the wellhead WH being removed and a workover or drilling assembly being positioned relative to the top of the well.

As shown in FIG. 1, the casing C extends from the top of the well to the bottom thereof with a cylindrical fluid flow conduit 10 being cylindrically disposed within the casing C and carrying at its lowermost end a well packer WP. The well tool 100 is shown being carried on the cylindrical fluid flow conduit 10 above the well packer WP.

Figure 2:
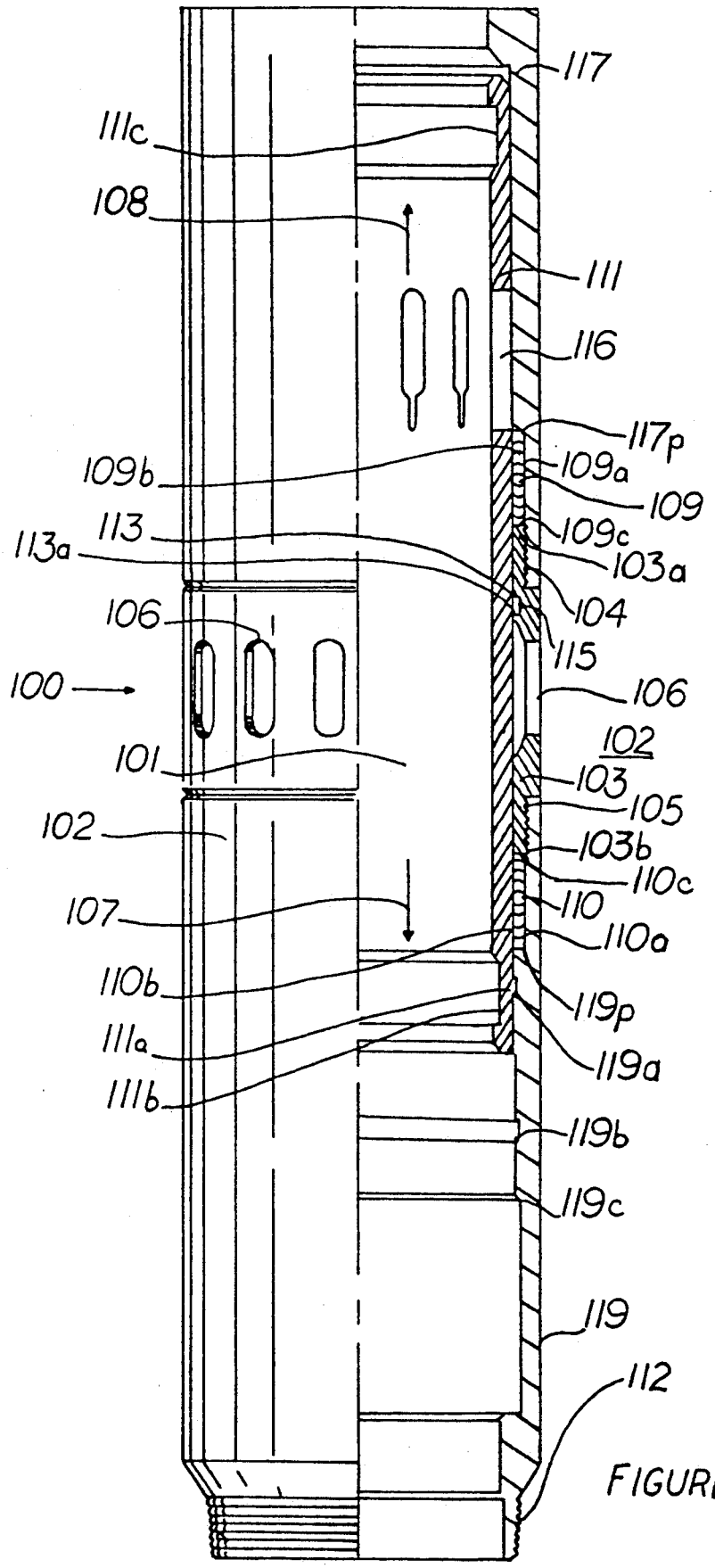
FIG. 2 is a longitudinally extending sectional view, partly interior and partly exterior, of the apparatus of the present invention with the port in a fully closed position.

Now with reference to FIG. 2, the well tool 100 is secured at its uppermost end to a first tubular member 117 forming a portion of the cylindrical fluid flow conduit 10, and at its lowermost end to a second tubular member 119 forming the lowermost end of the cylindrical fluid flow conduit 10 and extending on to the well packer WP at threads 112. Alternatively, the well tool 100 which the invention is in may also be provided in a form wherein members 117, 119 are actual parts of the well tool itself, with members 117, 119 and 103 forming the entire outer housing.

The well tool 100 has a cylindrical interior 101 and an exterior 102 which are permitted to be selectively communicated therebetween by means of a fluid communication port 106.

In the position as shown in FIG. 1, it will be assumed that production fluids are to flow through the cylindrical fluid flow conduit 10 from below the well packer WP to the top of the well, but such flow could be in the opposite direction. Thus with reference to FIGS. 2, 3, and 4, the arrow 108 in the interior of the tool above the fluid communication port 106 is defined as pointing towards the downstream flow portion relative to the port 106 and the arrow 107 below the fluid communication port 106 is defined as pointing towards the upstream area of the fluid flow, as described.

The well tool 100 has a primary sealing means 109 downstream of a first threaded end 104. As shown, the sealing means 109 is comprised of a series of Chevron shaped thermoplastic compound elements, but may be in the form and include a number of well known sealing components for sliding sleeve mechanisms utilized in the well completion art.

With reference to FIG. 2, the sealing means 109 includes a lower face **109*c* which is in abutting engagement with the uppermost end 103*a* of the housing 103 which, in effect, is an abutting shoulder for receipt of the lower end of the sealing means 109**.

An interior sealing face **109*b* of the sealing means 109 projects interiorly of the inner wall of the first tubular member 117 for dynamic sealing engagement with a cylindrical shifting sleeve 111 concentrically positioned within the well tool 100. Likewise, the sealing means 109 also has an outer face 109*a* facing exteriorly and away from the sleeve 111 for sealing engagement with the inner cylindrical wall of the first tubular member 117. The sealing means 109 is thus contained within a profile 117*p* of the first tubular member 117**.

The sleeve 111 is normally secured in position for running into the well as shown in FIG. 2, where the fluid communication port 106 is closed. In some operations, for equalization purposes, and the like, the sleeve 111 may be placed in the "open" position such that the fluid communication port 106 is in fluid communication with the interior 101 of the well tool 100 from the exterior 102 thereof. In any event, when the sleeve 111 is in the position where the fluid communication port 106 is in the "closed" position, an outwardly extending flexible latch element **111*a* is secured within an upper companion groove 119*a* on the tubular member 119. A shifting neck 111*b* is defined at the lowermost end of the sleeve 111 for receipt of a shifting prong (not shown) of a wireline, coiled tubing, or the like, shifting tool for manipulating the sleeve 111 from one position to another position relative to the fluid communication port 106. As the shifting prong engages the shifting neck 111*b*, a downward load may be applied across the shifting prong through the shifting neck 111*b* to the sleeve 111 to move same, such as from the fully "closed" position shown in FIG. 2, to the intermediate equalizing position shown in FIG. 3, or the fully open position shown in FIG. 4. Once sleeve 111 is shifted, the latch 111*a* will rest in snapped engagement in the intermediate groove 119*b* upstream of the groove 119*a* and, in such position, the sleeve 111 is in the equalized position. Continued downward movement will move the sleeve 111 to the fully open position, and the latch 111*a* will be in the groove 119*c*. Of course, the sleeve 111 may also be moved by appropriate connection of a shifting tool at an alternate shifting neck 111*c* at the top end of the sleeve 111**.

Figure 9A:
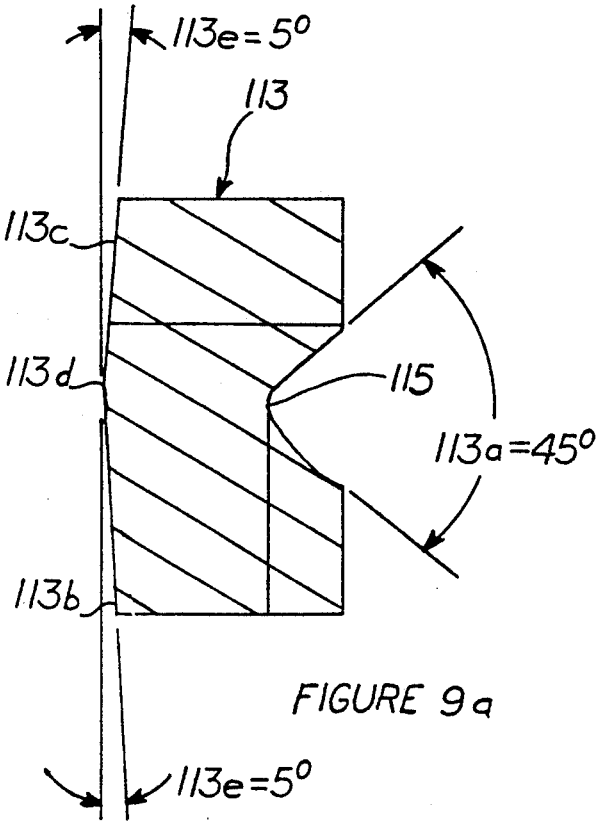
FIG. 9*a* is an enlarged view of the preferred diffuser element of the wellbore tool of the present invention.

With reference to FIG. **9*a* and 9*b*, the fluid flow diffuser ring 113 has an outwardly defined angled expansion area 115, with an angle 113*a* equal to 45° around its exterior circumferential surface to permit the components of the fluid flow diffuser ring 113 to expand therein as the well tool 100 encounters increased temperatures and pressures within the well W during operations. A fluid flow diffuser ring inner wall 113*a* is formed of two surfaces, fluid flow diffuser surface 113*b* and fluid flow diffuser flow surface 113*c*, which are radially oppositely inclined and come to a fluid flow diffuser contact point 113*d* which will sealingly engage along the exterior surface of the sleeve 111 such that there is no effective fluid flow across the primary sealing means 109 as the sleeve 111 is shifted to open the fluid communication port 106 relative to the interior 101 of the tool 100. With reference to FIG. 9*a* fluid flow diffuser surfaces 113*b* and 113*c* are both radially inclined from the exterior surface of 111, which is surface 111*f*, at a diffuser contact inclination angle 113*e* equal to 5° which is measured from an axial direction. The diffuser contact inclination angle serves to reduce frictional forces that will be encountered when fluid flow diffuser 113 forcibly engages the relatively moveable exterior surface 111*f* of sleeve 111. It should also be noted that the contact inclination angle for surfaces 113*b* and 113*c*** need not be the same, although they are the same in this preferred embodiment.

The fluid flow diffuser ring 113 may be made of any substantially hard nonelastomeric but plastic material such as Polyetheretherkeytone (PEEK), manufactured and available from Green, Tweed & Company, Kulpsville, Pa. It will be appreciated that the fluid flow diffuser ring 113 is not a conventional elastomeric seal which degrades rapidly during shifting, or other "wiper" which only serves the function of wiping solid or other particulate debris from around the outer exterior of the sleeve 111 as it dynamically passes across the sealing means 109 but, rather, the fluid flow diffuser ring 113 acts to substantially eliminate fluid flow to prevent fluid flow damage to the primary sealing assembly, 109.

Below the fluid communication port 106 and positioned at the lowermost end of the housing 103 in the upstream direction 107 from the second threaded end 105 is a second sealing means 110 emplaced within a profile 119*p* of the tubular member 119. This sealing means 110 may be of like construction and geometrical configuration as the sealing means 109, or may be varied, to accommodate particular environmental conditions and operational techniques.

With reference to FIG. 2, the sealing means 110 has an upper face 110*c* which abuts the lowermost end 103*b* of housing 103 below the second threaded end 105 of housing 103. The outer face of the seals 110*a* is in sealing engagement with the inner wall of the profile 119*p* of the second tubular member 119. Additionally, the interior face 110*b* of sealing means 110 faces inwardly for dynamic sealing engagement with the sleeve 111 positioned thereacross.

The well tool 100 is assembled into the cylindrical fluid flow conduit 10 for movement within the casing C by first securing the housing to the first and second tubular members 117, 119 at their respective threaded ends 104, 105. The sleeve 111 will be concentrically housed within the well tool 100 at that time with the sealing means 109, 110 in position as shown in, for example, FIG. 2.

During makeup, the seal means 109, 110, will, of course, be secured within their respective profiles 117*p* and 119*p*. Now, the first tubular member 117 and/or the second tubular member 119 are run into the well W by extension thereto into a cylindrical fluid flow conduit 10 with, in some instances, the well packer WP being secured at the lowermost end of the second tubular member 119 at, for example, threads 112. If the well tool 100 is run into the well in the closed position, the well tool 100 will be in the position as shown in FIGS. 1 and 2.

Figure 3:
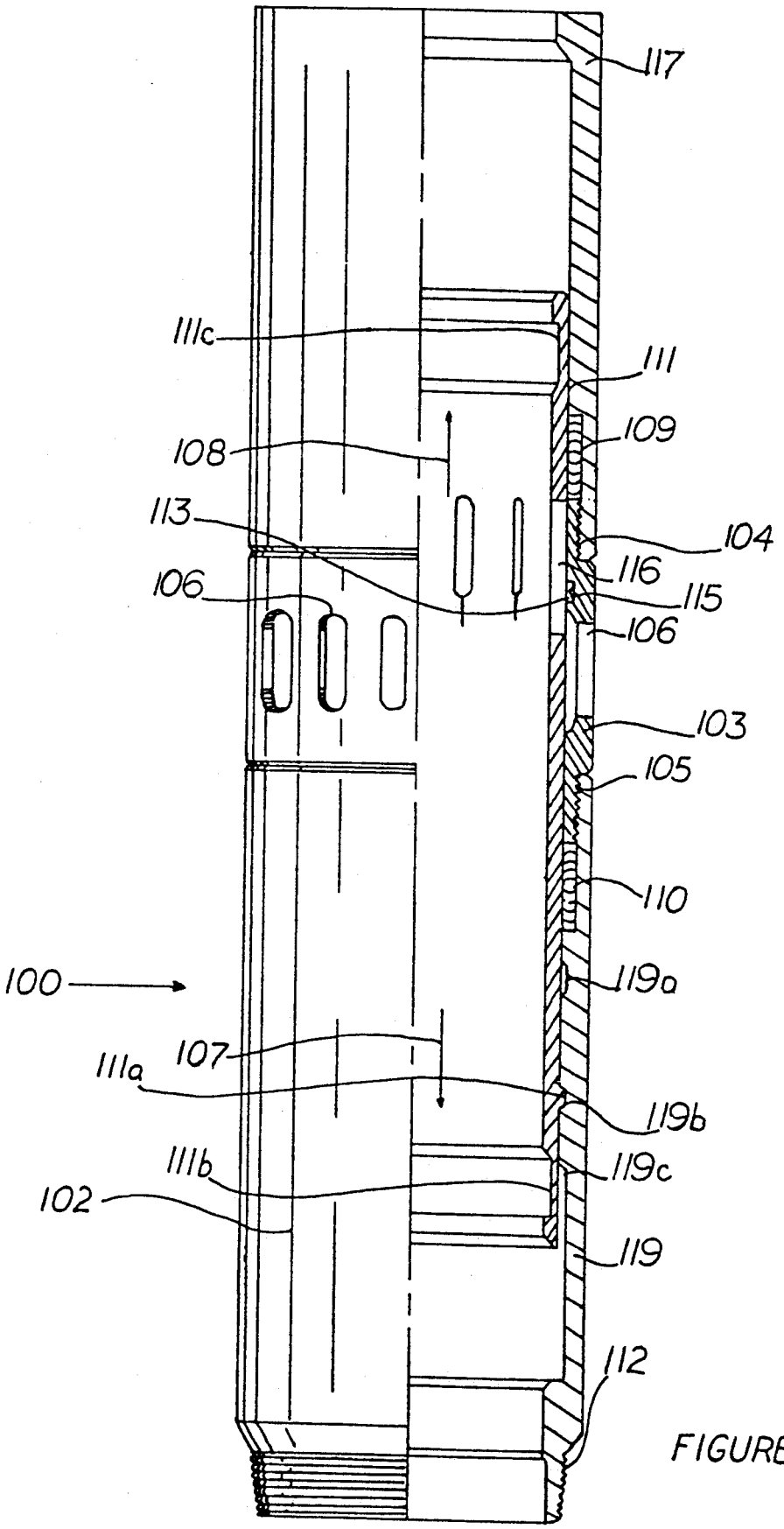
FIG. 3 is a view similar to FIG. 2 showing the apparatus with the sleeve and port in an intermediate, or equalizing position.

When it is desired to open the fluid communication port 106, the sleeve 111 is manipulated from the position shown in FIG. 2 to the position shown in FIG. 3, where pressure exterior of the well tool 100 and interior thereof are first equalized. It will be appreciated that the positioning and location of the sealing means 109, 110 relative to their respective threaded ends 104, 105, eliminate the necessity of a fluid tight seal being required between these threaded members, thus greatly reducing by a factor of 50 percent the number of locations for possible loss of pressure integrity within the well tool 100.

Additionally, it will also be appreciated that such positioning of the primary seal 109 in a position in the downstream direction 108 relative to the fluid flow diffuser 113 prevents such seals from being exposed to fluid flow when the sleeve 111 is shifted from the position shown in FIG. 2, where the fluid communication port 106 is isolated from the interior 101 of the tool 100, to the equalizing position, shown in FIG. 3.

Figure 4:
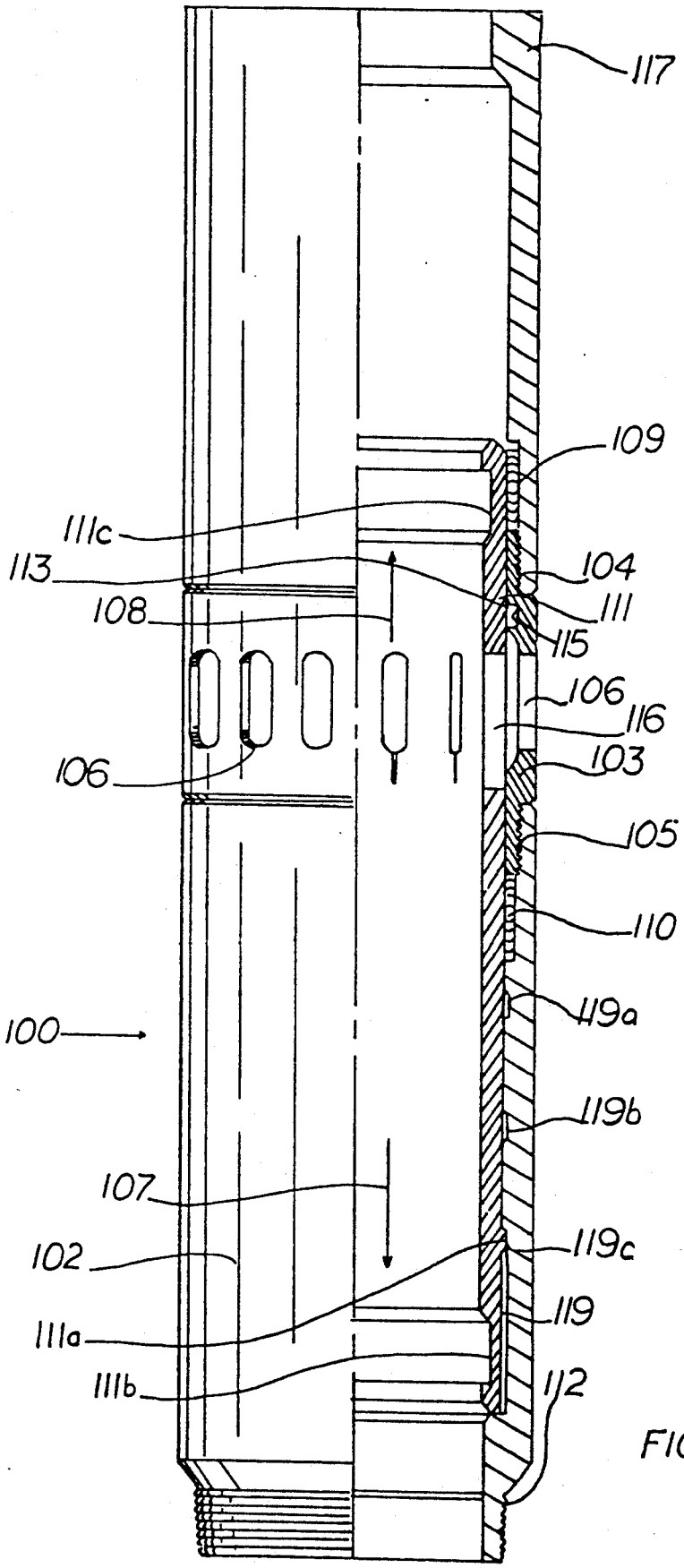
FIG. 4 is a view similar to that of FIGS. 2 and 3 showing the port of the well tool of the present invention in an open condition.

Subsequent to the shifting of the sleeve 111 to the equalized position, it may be opened fully to the position shown in FIG. 4. Where equalization is not deemed to be a particular problem because of comparative low pressure environments of operation, the tool may, of course, be shifted from the position shown in FIG. 2 to the position shown in FIG. 4, without any sort of time in the equalization position shown in FIG. 3.

Figure 5:
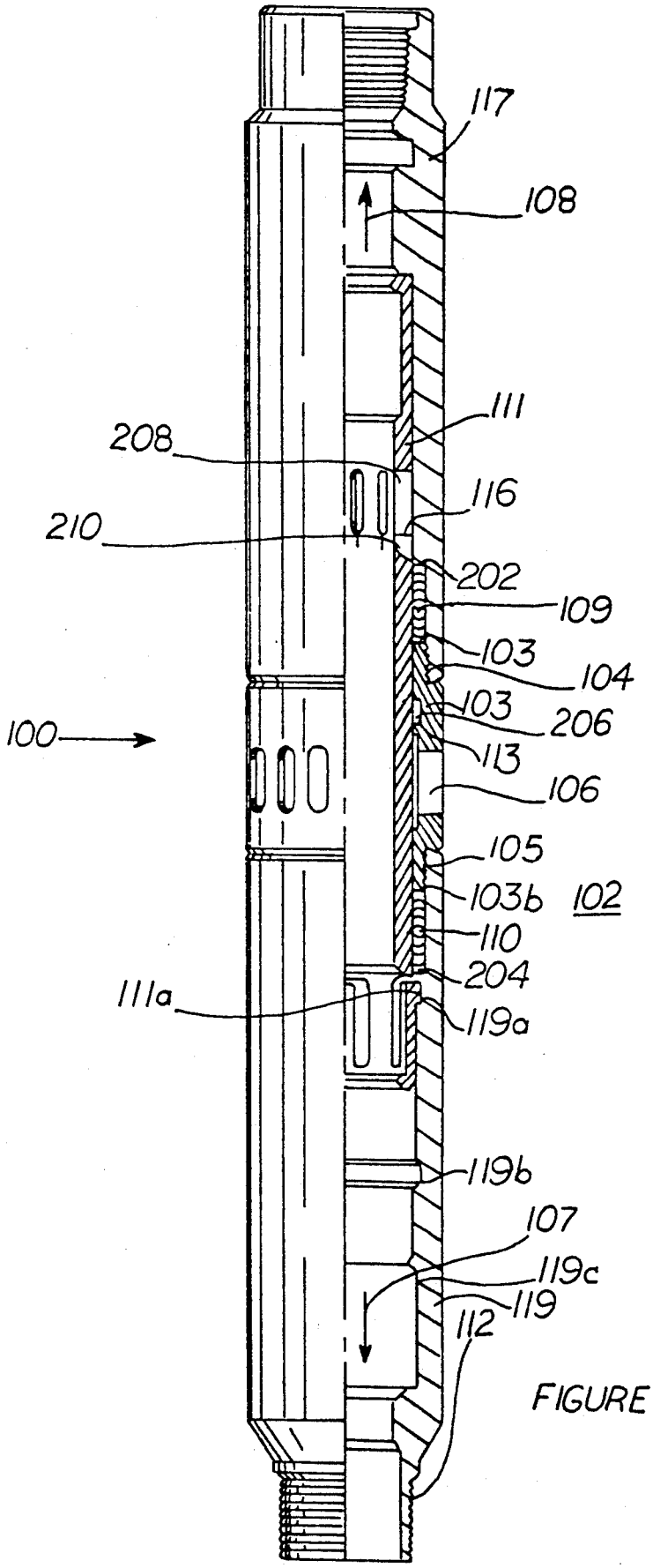
FIG. 5 is a longitudinally extending quarter sectional view of the wellbore tool of the present invention shown in a closed position.
Figure 9B:
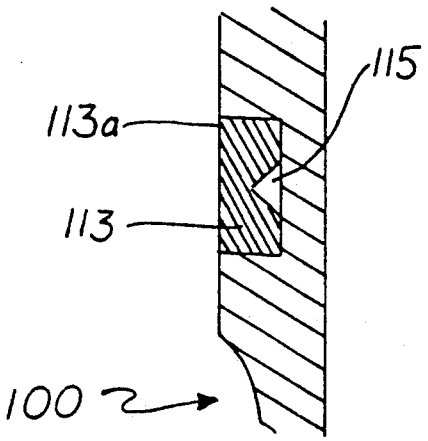
FIG. 9*b* is a partial section view which illustrates a fluid flow diffuser positioned within the wellbore tool of the preferred embodiment of the present invention.

FIG. 5 is a one-quarter longitudinal section view of wellbore tool 100 which utilizes the present invention, shown in a closed position. In this position, fluid in exterior region 102 is prevented from passing into wellbore tool 100 through communication port 106, by the position of sleeve 111. As shown in FIG. 5, a number of components cooperate to form the preferred wellbore tool 100 of the present invention. These components include upper sub 117, lower sub 119, sleeve 111, and housing 103, and upper and lower seal means 109, 110. A diffuser fluid flow element 113 is also provided. As shown, the upper and lower seal cavities 202, 204 are provided in a region formed between upper and lower subs 117, 119, and sleeve 111. Upper cavity 202 is bounded at its lower end by housing 103. Lower cavity 204 is bounded at its upper end by the lower end of housing 103. Communication port 106 is centrally disposed on housing 103, and has fluid communication with exterior 102 of wellbore tool 100. Fluid in the annular region between wellbore tool 100 and the wellbore wall, or casing, will be allowed to flow inward of wellbore tool 100 when sleeve 111 is moved from the closed position of FIG. 5 to the open position of FIG. 7. In the equalized position of FIG. 6, sleeve 111 is in an intermediate position, which allows a very limited amount of fluid to flow from exterior 102 to wellbore tool 100 to equalize the pressure differential therebetween.

Returning now to FIG. 5, housing 103 is further equipped with diffuser cavity 206, which is adapted to receive diffuser 113. Diffuser 113 is provided between communication port 106, and upper seal means 109, and serves to diminish the force impact of high pressure fluid from exterior 102 to prevent damage to upper seal means 109. As shown in FIG. 5, diffuser 113 is positioned upward from communication port 106, and is especially suited for diminishing the force impact of high pressure fluid when fluid is flowing upward within wellbore tool 100 in the direction of downstream flow arrow 108. However, in alternative embodiments, the direction of flow may be opposite that of downstream flow arrow 108.

As shown in FIG. 5, sleeve 111 is provided in close proximity to upper and lower subs 117, 119, and is in facial and sliding interface with upper and lower sealing means 109, 110 and includes fluid slots 208, having selected ones which terminate at the lower end at equalization inlets 210, which have a diminished fluid flow capacity in comparison to fluid slot 208. Fluid slot 208 and equalization inlet 210 together define port 116 in sleeve 111. FIG. 5 depicts one fluid slot 208 in partial longitudinal section, which terminates at its lower end at equalization inlet 210. Fluid flow from exterior 102 through communication port 106 is allowed when either equalization inlet 210 or fluid slot 208 is aligned with communication port 106. In the preferred embodiment, a plurality of communication ports 106 are provided circumferentially around housing 103, each communicating with a selected fluid slot 208, or fluid slot 208 with equalization inlet 210, which are circumferentially disposed about sleeve 111.

Figure 6:
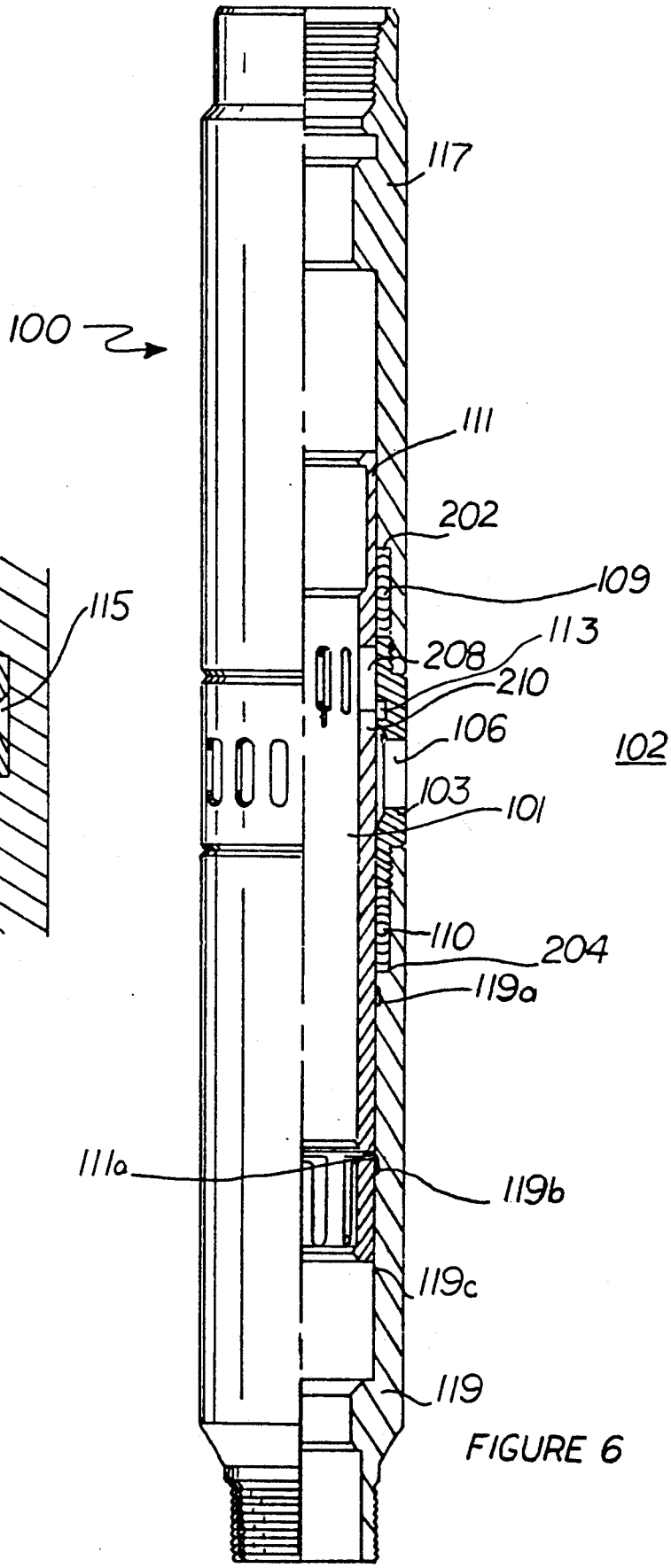
FIG. 6 is a longitudinally extending quarter sectional view of the wellbore tool of the present invention shown in an intermediate equalizing position.
Figure 7:
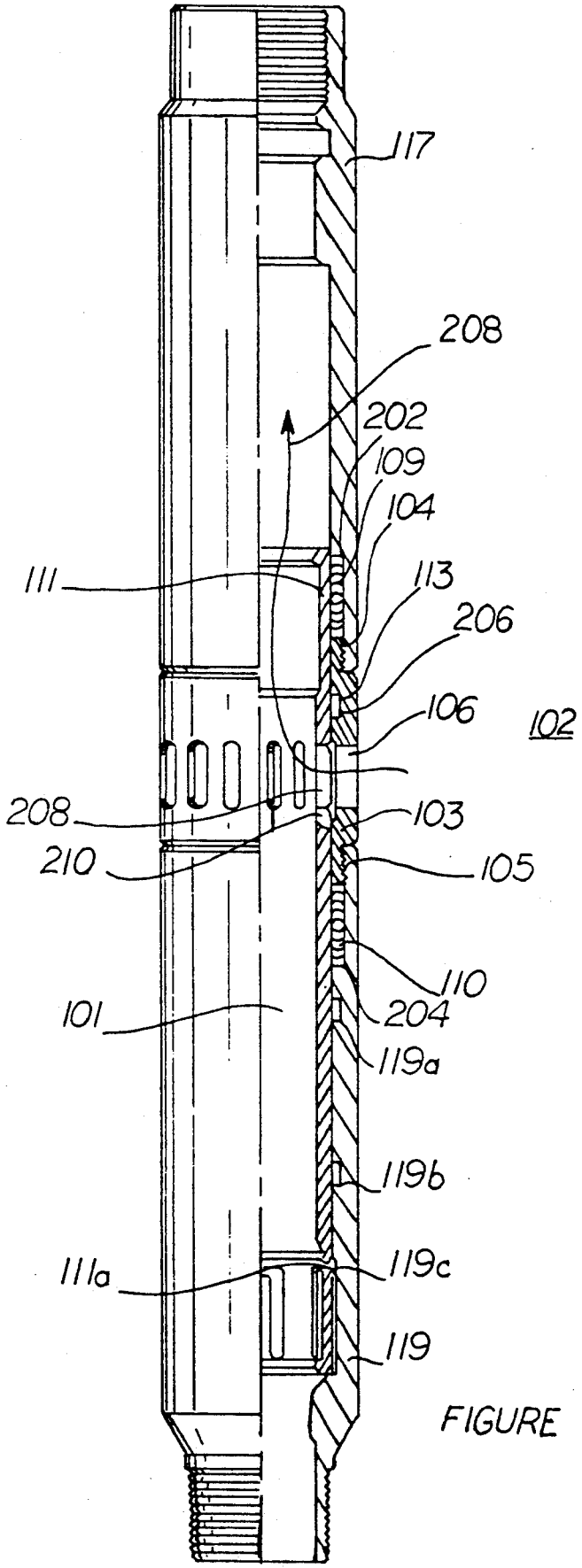
FIG. 7 is a longitudinally extending quarter sectional view of the wellbore tool of the present invention shown in an open position to allow fluid communication between the exterior and interior of the wellbore tool.

Several important features of the wellbore tool which utilizes the present invention are graphically depicted in FIGS. 5, 6, and 7.

First, it is important to note that threaded ends 104 and 105, with threads 104*a* and 105*a* respectively, which serve to couple housing 103 to upper and lower subs 117, 119, are disposed between upper and lower sealing means 109, 110, along with communication port 106. Therefore, the interface of upper sub 117, and housing 103 need not be sealed with O-ring seals, or other seal elements, as is conventional in the prior art. In addition, the coupling of housing 103 and lower sub 119 likewise need not be provided with seals such as O-ring seals, or other conventional seals, as is conventional in the prior art. This elimination of the need for seals at the junction of upper sub 117 and housing 103, and lower sub 119 and housing 103, eliminates the requirement for additional seals and thus reduces the total number of sealing elements required for wellbore tool 100. This is a significant advantage over the prior art devices since each seal element poses an additional risk of failure, especially over the course of time as the materials which comprise prior art elastomeric seal elements eventually deteriorate.

In the wellbore tool 100, as shown in FIG. 5, upper and lower seal means 109, 110 are provided in upper and lower seal cavities 202, 204, and provide a seal against the passage of fluid upward or downward along the interface of upper and lower subs 117, 119 and sleeve 111. In the preferred embodiment, upper and lower sealing means 109, 110 preferably do not include elastomeric elements which will degrade over time.

FIG. 6 shows the wellbore tool which utilizes the present invention in an equalized position, with equalization inlet 210 in fluid communication with communication port 106, for receiving fluid from exterior 102 for passage into interior 101. In the preferred embodiment, equalization inlet 210 provides a restricted flow path, which allows for gradual diminishment of the pressure differential between interior 101 and exterior 102. Fluid which is directed from exterior 102 is passed across diffuser element 113, which limits the rate of flow from exterior 102 to interior 101.

A second important feature of the wellbore tool 100 is that during the equalization mode of operation, upper and lower sealing means 109, 110 are maintained in a protected position, completely enclosed within upper and lower seal cavities 202, 204. Diffuser element 113 alone is exposed to the high forces of fluid during the equalization mode of operation. In the equalization mode of operation, fluid slot 208 has traveled downward relative to upper seal cavity 202, so that no portion of fluid slot 208 is aligned with upper sealing means 109. Instead, sealing means 109 is contained entirely within upper seal cavity 202, with upper sub 117 on one side, and sleeve 111 on the opposite side. Thus, during the equalization mode of operation, as depicted in FIG. 6, upper seal means 109 is not exposed to substantial fluid flow from either interior 101 or exterior 102, and is certainly not exposed to any appreciable flow of high pressure fluids. Subjecting upper seal means 109 to high pressure fluid flow during the equalization mode of operation could result in damage to upper seal means 109. Thus, in wellbore tool 100, it is extremely important that no portion of upper seal means 109 be exposed to substantial high pressure wellbore fluid flow during the equalization mode of operation when prior art packing stacks, or sealing assemblies, and used.

In the preferred embodiment of wellbore tool 100 diffuser 113 is exposed to substantial wellbore fluid flow potential only during the equalization mode of operation. This is revealed by comparison of FIGS. 6 and 7 which depict respectively the equalization position and open position. As shown in FIG. 7, diffuser 113 is maintained in diffuser cavity 206 during the flowing mode of operation Diffuser 113 is somewhat protected from the flow of fluid by sleeve 111 which is in abutment and disposed radially inward from diffuser element 113. As shown in FIG. 7, during a flowing mode of operation, communication port 106 is in alignment with fluid slot 208, allowing the fluid to flow from exterior 102 to interior 101 in the direction of arrow 208. If leak paths develop at threads 104*a*, 105*a*, the performance of wellbore tool 100 will not be diminished, since fluid may flow downward along the interface of sleeve 111 and housing 103 only to seals 109, 110, respectively.

Figure 8:
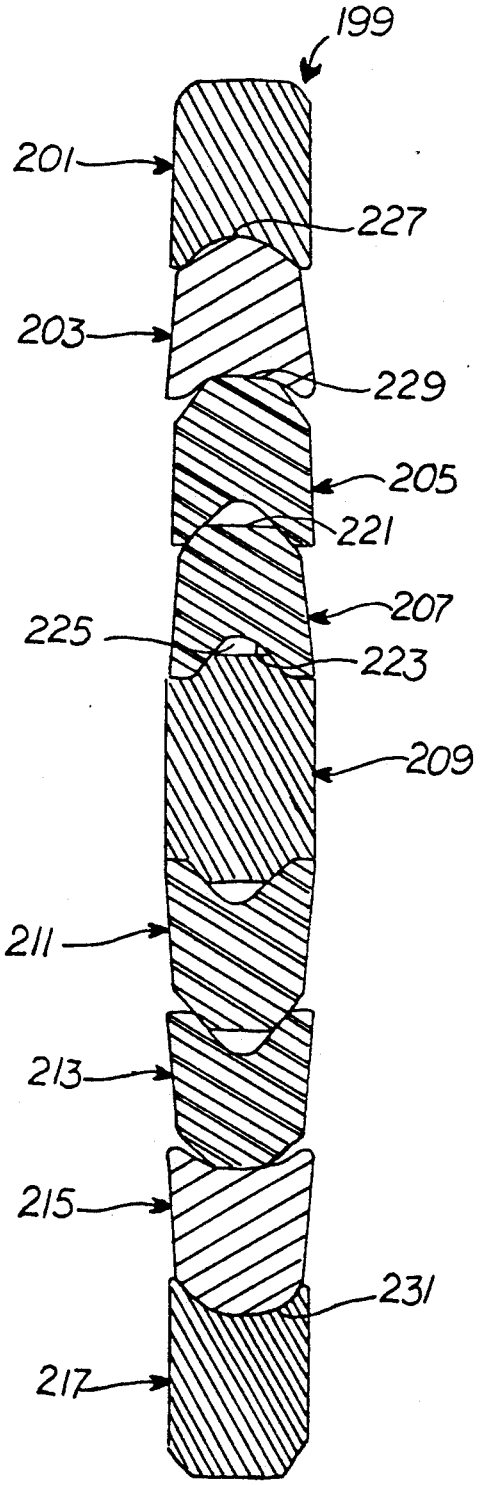
FIG. 8 is an enlarged view of a prior art PT-3 Packing Stack previously used in the wellbore tool.

FIG. 8 is an enlarged view of a prior art packing stack 199. FIG. 8 is a radial cross-section of prior art packing stack 199. A radial cross-section is herein defined as a longitudinal cross-section in a plane containing the axial centerline of the ring which is cross-sectioned, which in this case is the axial longitudinal centerline of the well tool 100, and is only a portional view of a full diametrical cross-section which would show both sides of the ring which is cross-sectioned. The radial cross-section only shows half of the diametrical cross-section.

Prior art packing stack 199 is comprised of the seal elements which were disposed in upper and lower sealing means 109, 110. Prior are packing stack 199 included a number of prior art components which cooperated together to form a fluid-tight seal when disposed in either upper or lower seal cavities 202, 204, between upper and lower subs 117, 119, and sleeve 111. As shown, prior art packing stack 199 was equipped with the prior art center adapter 209, and end prior art adapters 201, 217, all of which were formed of metal. These elements essentially served as spacers and to prevent the flow of prior art chevron-shaped seals 205, 207, 211, 213, which are formed of a thermoplastic material, such as polytetrafluoroethylene, commonly referred to under the Du-Pont trademark as TEFLON. These prior art elements did not perform any sealing function either. It is important to keep in mind that these prior art center and end adapters 209, 201, 217 are circular in shape. FIG. 8 is merely a sectional view of these ring-like prior art.

In the prior art, three sealing elements were disposed between prior art center adapter 209 and prior art end adapter 201. Likewise, three sealing elements were provided disposed between prior art center adapter 209 and prior art end adapter 217. One set of sealing elements were disposed upward from prior art center adapter 209, and the other set of prior art sealing elements were disposed downward in position from center adapter 209. Since prior art packing stack 199 was symmetrical about prior art center adapter 209, the upward and downward directions have not been indicated in FIG. 8. It is also important to keep in mind that prior art packing stack 199 of FIG. 8 is snugly disposed in either upper or lower seal cavities 202, 204. The sealing elements disposed above and below center adapter 209 were subjected to axial compressive force which flared the sealing elements radially outward slightly to engage on one side either upper or lower sub 117, 119, and to engage on the other side sleeve 111. Engagement between the sealing elements and upper sub 117, lower sub 119, and sleeve 111 is a sealing engagement, which could withstand significant pressure differentials, and maintain a tight seal.

As shown in FIG. 8, prior art Chevron seals 205, 207 are disposed on one side of center adapter 209. Prior art Chevron seals 211, 213 are disposed on the opposite side of center adapter 209. Each prior art Chevron seal 205, 207, 211, 213 is equipped with one male end 221, and one female end 223. Each female end 223 is equipped with a central cavity which is adapted for receiving other male ends of the sealing and adapter rings of packing stack 199.

With reference to the prior art, Chevron seals 205, 207, 211, 213 are flared slightly outward at female ends 223, and are maintained in a protected position, completely enclosed within upper and lower seal cavities 202, 204. Diffuser element 113 alone is exposed to the force improve of high pressure fluid flow during the equalization mode of operation, when the prior art packing stack 199, and when the present invention seal assembly are used in wellbore tool 100.

In the equalization mode of operation, fluid slot 208 has traveled downward relative to upper seal cavity 202, so that no portion of fluid slot 208 is aligned with upper sealing means 109. Instead, sealing means 109 is contained entirely within upper seal cavity 202, with upper sub 117 on one side, and sleeve 111 on the opposite side. Thus, during the equalization mode of operation, as depicted in FIG. 6, upper seal means 109 is not exposed to fluid from either interior 101 or exterior 102, and is certainly not exposed to any flow of high pressure fluids. Subjecting upper seal means 109 to substantial high pressure fluid fluid during the equalization mode of operation could result in damage to upper seal means 109. Thus, it is extremely important that no portion of upper seal means 109 be exposed to substantial high pressure wellbore fluid flow during the equalization mode of operation.

In the preferred embodiment of wellbore tool 100, diffuser 113 is placed in the flow path of wellbore fluids only during the equalization mode of operation. This is revealed by comparison of FIGS. 6 and 7 which depict respectively the equalization position and open position. As shown in FIG. 7, diffuser 113 is maintained in diffuser cavity 206 during the flowing mode of operation, which is depicted in FIG. 7, and substantially shielded from the fluid flow path. Diffuser 113 is somewhat protected from the flow of fluid by sleeve 111 which is in abutment and disposed radially inward from diffuser element 113. As shown in FIG. 7, during a flowing mode of operation, communication port 106 is in alignment with fluid slot 208, allowing the fluid to flow from exterior 102 to interior 101 in the direction of arrow 208.

If leak paths develop at threads 104*a*, 105*a*, the performance of wellbore tool 100 will not be diminished, since fluid may flow downward along the interface of sleeve 111 and housing 103 only to seals 109, 110, respectively.

Figure 11:
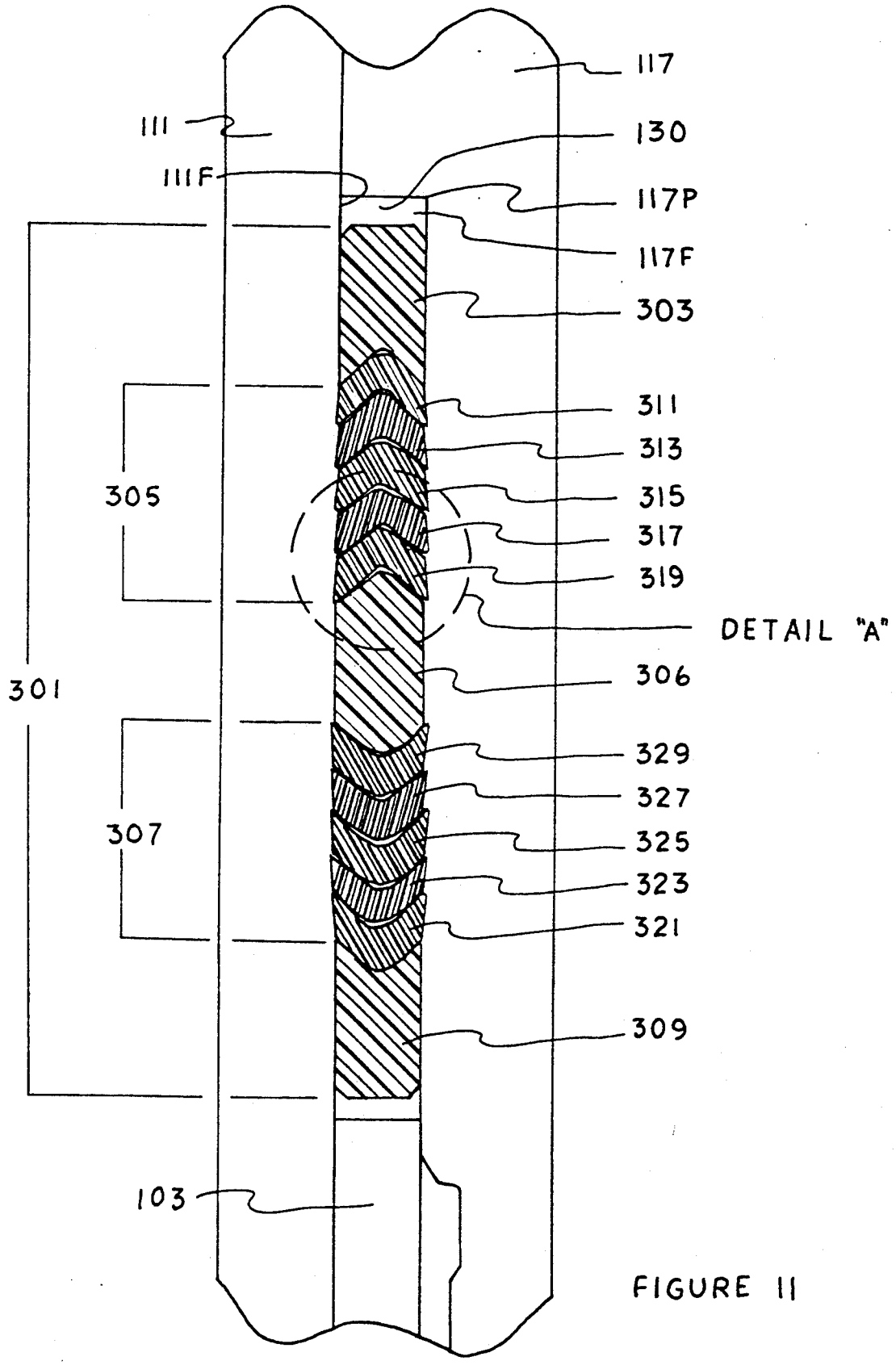
FIG. 11 is a one quarter longitudinal section of a cylindrical wellbore tool showing the sealing apparatus of the present invention.

With reference now to the present invention and in particular with reference to FIG. 11, which is a radial cross-sectional view of a section of wellbore tool 100 shown with the preferred embodiment of the sealing means of this invention, bidirectional seal assembly 301, replacing prior art packing stack 199. A tubular member 117 and a cylindrical housing 103 are shown together comprising an entire housing within which a cylindrical shifting sleeve 111 concentrically moves. Tubular member 117 has a profile 117*p* which together with the axially upper end of cylindrical housing 103 and the sliding sleeve outer surface 111*f* of sliding sleeve 111 form a seal cavity 130.

A bidirectional seal assembly 301, which is comprised of a series of axially aligned mating seal rings, is shown disposed inside of cavity 130 to seal between sliding sleeve outer surface 111*f* and inner surface 117*f* of tubular member 117. Bidirectional seal assembly 301 sealingly engages both surface 111*f* and surface 117*f* to prevent flow therethrough in either axial direction. Bidirectional seal assembly 301 is comprised of, from top to bottom, a seal assembly end adapter 303, a unidirectional seal stack 305, a seal assembly center adapter 306, a unidirectional seal stack 307, and a seal assembly end adapter 309.

Unidirectional seal ring stack 305 is comprised of a number of mating cylindrical seal rings which are stacked in alternating layers of retainer seal rings axially disposed on each side of thermoplastic seal rings with a first retainer seal ring 311 disposed adjacent to the lower end of seal assembly end adapter 303. First thermoplastic seal ring 313 is then disposed axially adjacent to the first retainer seal ring 311. On the opposite side of thermoplastic seal ring 313 from retainer seal ring 311 is second retainer seal ring 315, which axially disposes first thermoplastic seal ring 313 between two adjacent retainer seal rings 315 and 311. Immediately below and adjacent to second retainer seal ring 315 is second thermoplastic seal ring 317 with third retainer seal ring 319 immediately below second thermoplastic seal ring 317. Below retainer seal ring 319 is center adapter 306.

Immediately below center adapter 306 is unidirectional seal ring stack 307, which is a mirror image of unidirectional seal ring stack 305 and aligned axially opposite of unidirectional sealing stack 305. Unidirectional seal ring stack 307 is comprised of alternating layers of thermoplastic seal rings and retainer seal rings, with thermoplastic seal ring 327 between retainer seal rings 329 and 325, and thermoplastic seal ring 323 between retainer seal rings 325 and 321. Unidirectional seal ring stack 307 is immediately above and adjacent to end adapter 309.

Figure 12A:
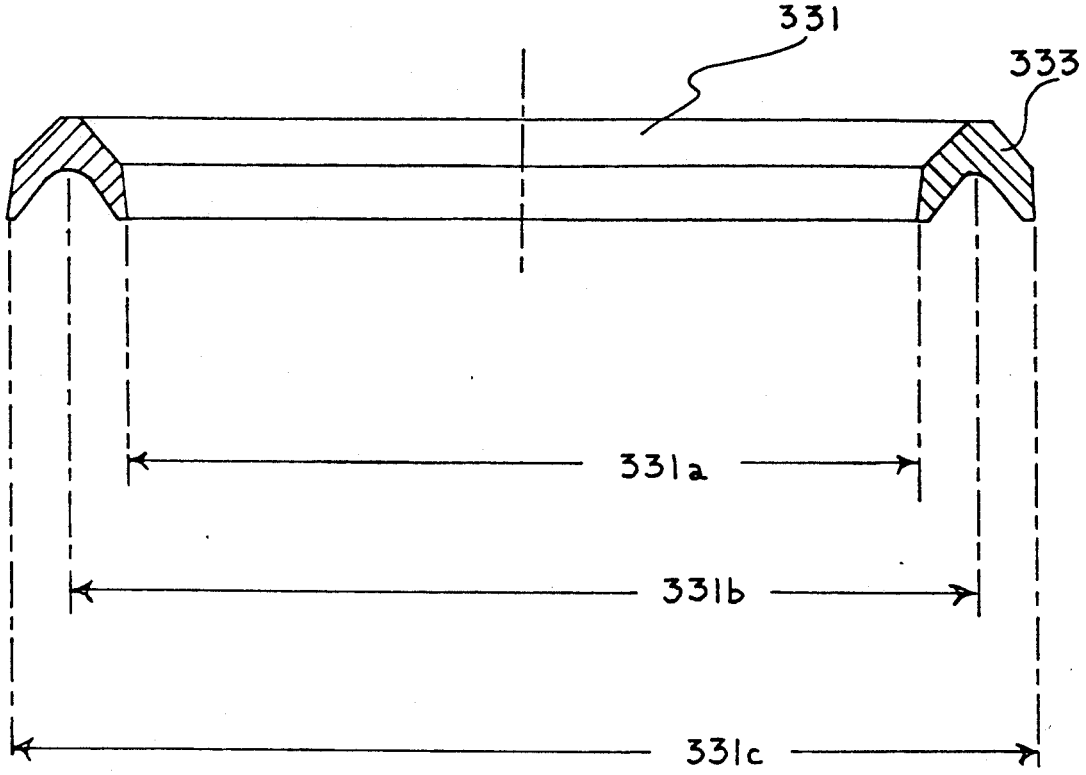
FIG. 12*a* is a full cross-sectional view of a cylindrical ring with a generally chevron shape which is the same shape as the seal rings of the invention.

FIG. 12*a* is a cross-sectional view of a cylindrical ring 331 having a radial cross-section 333 of a generally chevron shape. In the preferred embodiment, retainer seal rings 311, 315, 319, 329, 325, and 321 are all formed in the shape of ring 331. In addition, thermoplastic seal rings 313, 317, 327, and 323 are also all formed in the shape of ring 331. Although retainer seal rings 311, 315, 319, 329, 325, and 321 are formed in the same shape as thermoplastic seal rings 313, 317, 327, and 323 in the preferred embodiment, they may be made in different shapes in other embodiments of this invention. In the preferred embodiment, cylindrical ring 331 has internal diameter 331*a* ranging from 2.870 inches to a maximum of 2.865 inches, and outer diameter 331*c* ranging from 3.263 inches to a maximum of 3.268 inches, and a mean diameter 331*b* in the range of 3.067 inches.

Figure 12B:
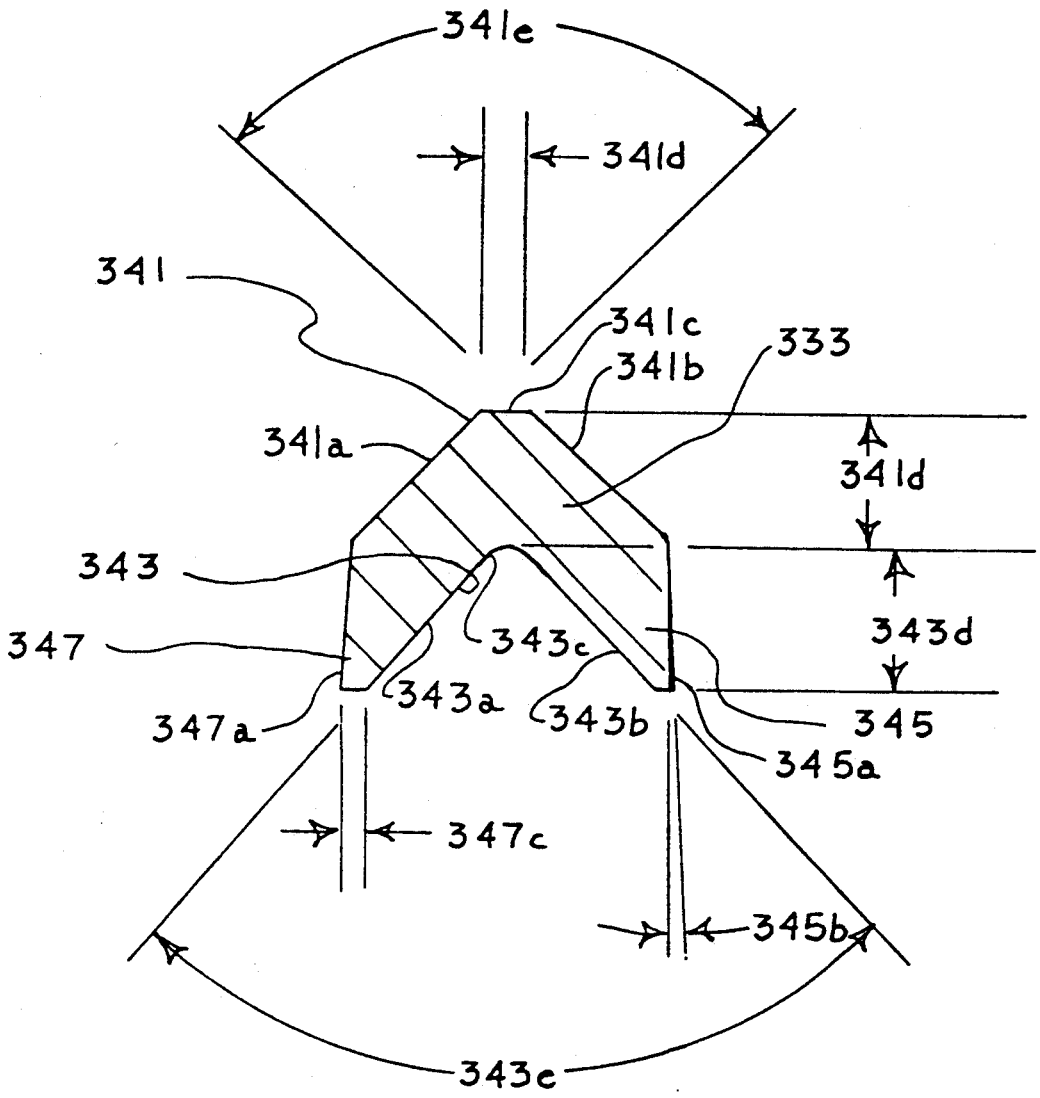
FIG. 12*b* is an enlarged sectional view of a radial cross-section having a generally chevron shape of FIG. 12*a*.

FIG. 12*b* is a detailed view depicting the generally chevron shape 333 of the radial cross-section of cylindrical ring 331. As shown in FIG. 12*b*, general chevron shape 333 has a nose 341 formed by two radially opposed, with reference to a radial direction of cylindrical ring 331, and oppositely inclined surfaces 341*b*, and 341*a*, which converge to form a generally outwardly protruding shape with a flat surface 341*c* on the end. Chevron shape 333 also has a crotch which is formed by two radially opposed and oppositely inclined surfaces 343*a*, and 343*b*, which inwardly converge to form an inwardly protruding surface 343 with a radiused, or rounded, center 343*c*.

Nose 341 has an axial thickness 341*d*, and crotch 343 has an axial thickness 343*d*. In defining general chevron shape 333, nose thickness 341*d* should be larger than crotch thickness 343*d* with nose thickness 341*d* ranging from 0.085 to a maximum of 0.090 inches, and with the sum of nose thickness 341*d* and crotch thickness 343*d* ranging from 0.155 inches to a maximum of 0.160 inches. In the preferred embodiment, the blunt radial surface of nose 341*c* is shown as being flat and measuring 0.020 to 0.025 inches across as shown by dimension 341*d* for flat surface 341*c*. This was done for ease of manufacturing the cylindrical rings having the radial cross-section of a general chevron shape. The nose may be formed as a radiused surface, that is a rounded radial surface, which is similar to 343*c*; however, it must be of a smaller dimension than radiused, or rounded, surface 343*c*. Seal assembly surface 343*c* is shown in the preferred embodiment as having a 0.030 radius.

Nose 341 has a nose angle 341*e*, which is the axially located projected angle between outwardly converging surfaces 341*a* and 341*b*. Crotch 343 has a crotch angle 343*e*, which is the axially located projected angle between inwardly converging surfaces 343*a* and 343*b*. In the preferred embodiment, nose angle 341*e* is approximately 96° and crotch angle 343*e* is approximately 86°.

Between mating pairs of seal rings there is an axially disposed interference fit between the nose of one ring and the adjacent crotch of a second ring. For example, with reference to FIG. 11, the nose of center adapter 306 is pushed forward into the crotch of retainer seal ring 319. And in turn, the nose of retainer seal ring 319 is pushed forward into the crotch of thermoplastic seal ring 317. The displacement in an axial direction of an adjacent nose into an adjacent crotch continues through retainer seal ring 315, thermoplastic seal ring 313, retainer seal ring 311, and seal assembly end adapter 303 until seal assembly end adapter 303 buts up against the axially upper end of profile 117*p* which keeps the entire bidirectional seal assembly from displacing any further. This axially disposal interference fit which increases with displacement in an axial direction of a nose into an adjoining crotch is herein defined by the term an axial interference fit, or a nose to crotch interference fit, even though a nose pushing an adjacent crotch out will also displace the adjacent crotch in a diametrical direction, in order to distinguish it from a diametrical interference fit due to a difference in sizes between the seal ring diameters and mating sliding sleeve outer surface 111*f* and cylindrical housing surface 117*f*.

Although both the retainer seal rings and the thermoplastic seal rings are of the same radial cross-section 333, they need not be. So long as there is an axial nose to crotch interference fit for the bidirectional seal assembly to be self energizing under the action of wellbore pressure.

In the preferred embodiment, a nose to crotch interference fit is found between the mating surfaces of retainer seal ring 319 and thermoplastic seal ring 317. The nose to crotch interferenced fit is the difference between nose angle 341*e* and crotch angle 343*e* of general chevron shape 333.

The dimensions in the preferred embodiment of a nose angle of 96° and a crotch angle of 86° define a nose to crotch interference fit between a mating nose 341 with a crotch 343 of 10°. Although the nose to crotch interference fit is shown as 10°, other nose to crotch interference fit angles may be satisfactory if they are less than 20°. Testing has shown that with a nose to crotch interference fit of 20°, if a well bore pressure is applied to the lower side of third retainer seal ring 319 at a high well bore temperature such as 270° and greater, then second thermoplastic seal ring 317 will be extruded when pressed between second retainer 317 and third retainer seal ring 319.

Radially opposing sides of chevron shape 333, which are both between nose 341 and crotch 343, will form a radially exterior chevron wing 345 and a radially interior chevron wing 347 as shown in FIG. 12B. Chevron wing 345 has a radially outermost exterior chevron wing surface 345*a*, which forms the outer diametrical circumferential surface of cylindrical ring 331. Radially interior chevron wing 347 has a radially innermost interior chevron wing surface 347*a*, which forms the inner circumferential diametrical surface of cylindrical ring 331. Chevron wing 345 has an exterior wing surface inclination angle 345*b* defined between an axial direction and radially innermost exterior chevron wing surface 345*a*. Radially interior chevron wing 347 has the same wing surface inclination angle 347*b* as chevron wing surface 345, defined between an axial direction and radially innermost interior chevron wing surface 347*a*. In the preferred embodiment, chevron wing surface 345*a* and 347*a* have wing surface inclination angles 345*b* and 347*b*, which are both equal to 3°. The purpose of the wing inclination angle is to reduce the frictional forces between the wing surfaces 345*a* and 345*b* and mating sealing surfaces 111*f* and 117*f* which they sealingly engage. Although wing surface inclination angles 345*b* and 347*b* are the same in the preferred embodiment, they may measure different angles from each other and they may also be different from 3 degrees in other embodiments of this invention.

Figure 10:
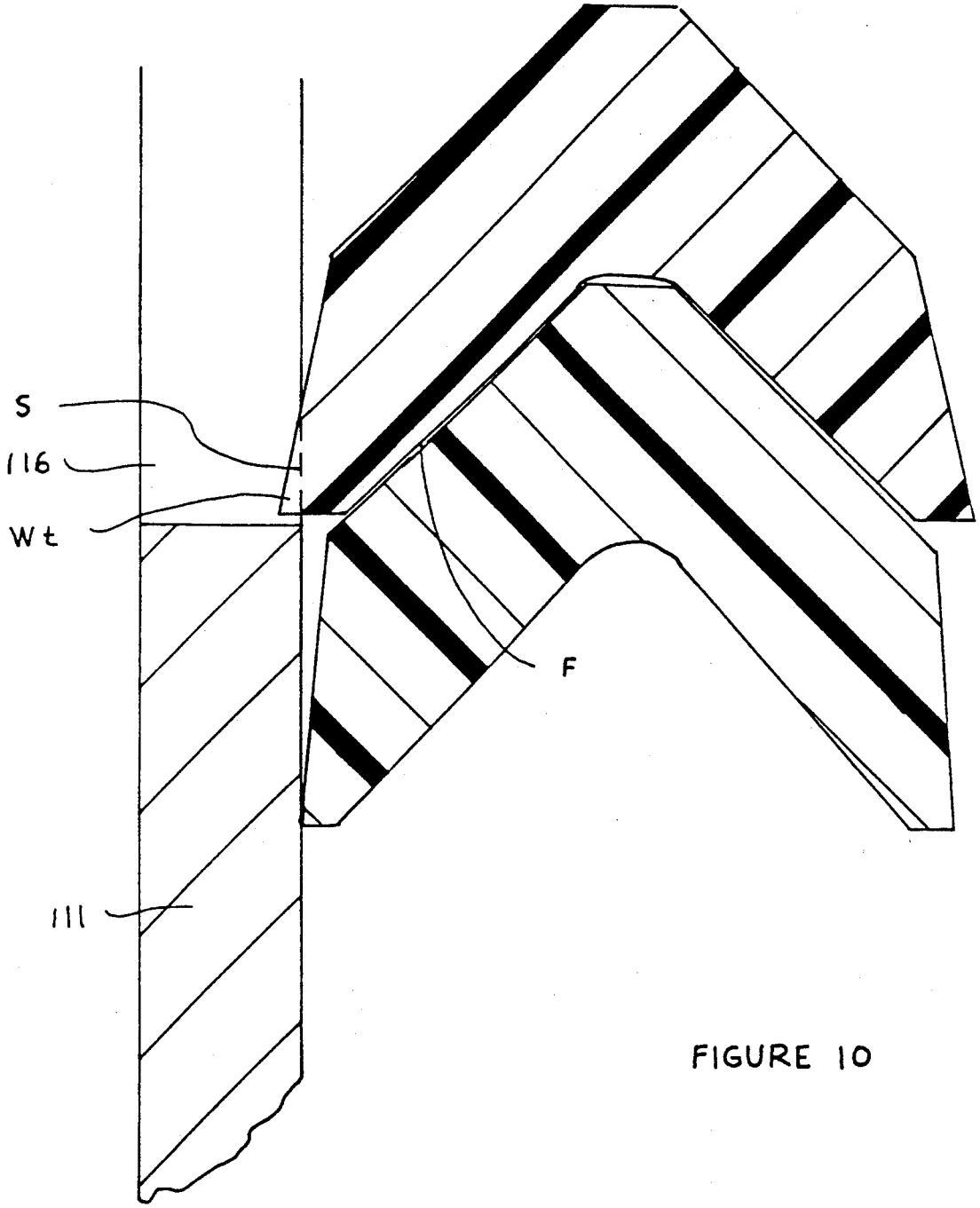
FIG. 10 is an enlarged cross-sectional view of a prototype Chevron shaped sealing apparatus of the present invention sealing apparatus in noncontinuous mating engagement with a ported sliding moveable member, such as may be seen when port 116 in sleeve 111 moves across the surface of seal member 109.

Chevron wings 345 and 347 also each have a radially outer lip 345*c* and 347*c* respectively. In the preferred embodiment, radially outer lips 345*c* and 347*c* measure between 0.015 inches and 0.025 inches. In other embodiments of this invention, chevron sealing surfaces 345*c* and 347*c* should be sized small enough so that the chevron wings will be thin enough to flare, or flex outward, when engaged by a mating nose of an adjacent seal ring acted upon, or pushed by wellbore fluid acted on by a wellbore pressure so that exterior chevron wing surfaces 345*a* and 347*a* will be energized so that they are pushed to engage adjacent sealing surface 117*f* and adjacent sliding sleeve outer surface 111*f* in sealing engagement. When this invention is used in an embodiment involving sealing engagement between a chevron wing and a moveable ported member with the port passing over the chevron wing surface, in a noncontinuous mating sealing contact, radially outer lips 345*c* and 347*c* should be sized large enough so that the chevron wings will have sufficient rigidity to be strong enough to resist being either pushed or extruded by the force of a mating chevron nose, or wellbore pressure, into the port, or slot, in the ported moveable member. Otherwise, if pushed or extruded into a ported moveable member, such as sliding sleeve 111 in the preferred embodiment, they will be caught in trailing edge of slot 116 and cut destroying their effective sealing integrity as shown in FIG. 10.

This balance in rigidity of the chevron wings to allow them to be pushed and flared into sealing engagement, yet to retain sufficient rigidity to not be pushed into the port and cut by the trailing edge of the port, slot 116, is critical to reliable operation of the sealing assembly over numerous actuations of the ported moveable member, sliding sleeve 111. In the preferred embodiment, this size was determined by experimentation. As shown in FIG. 10, initial tests were done with radially outer lips measuring less that 0.015 inches which failed to perform reliably when the axially disposed outer tips of the chevron wings, such as wing tip $w_t$ shown in FIG. 10, were caught in and cut by the trailing edge of slot 116. Later, tests were done with radially outer lips measuring more than 0.025 inches which failed to sealingly engage sliding sleeve 111. Then, the range in size from 0.015 inches to 0.025 inches was tested and was found to provide the proper balance of rigidity which is required for sealing members to perform reliably for repeated actuation of sliding sleeve 111. It should be noted that this balance is dependent upon complex relationships involving the geometry of the generally chevron shape, the strengths of the material from which the seal members are made, the temperature ranges over which the sealing members will be used, the pressure ranges over which the sealing members will be used, and the size of the noncontinuous surface which they will seal against. In the preferred embodiment, the size of the noncontinuous surface is generally determined by the circumferential width of slot 116. It should also be noted that in other embodiments the radially outer lips need not be flat, but may be a blunt surface which ranges in shape from a radiused, or rounded, to flat.

Figure 13A:
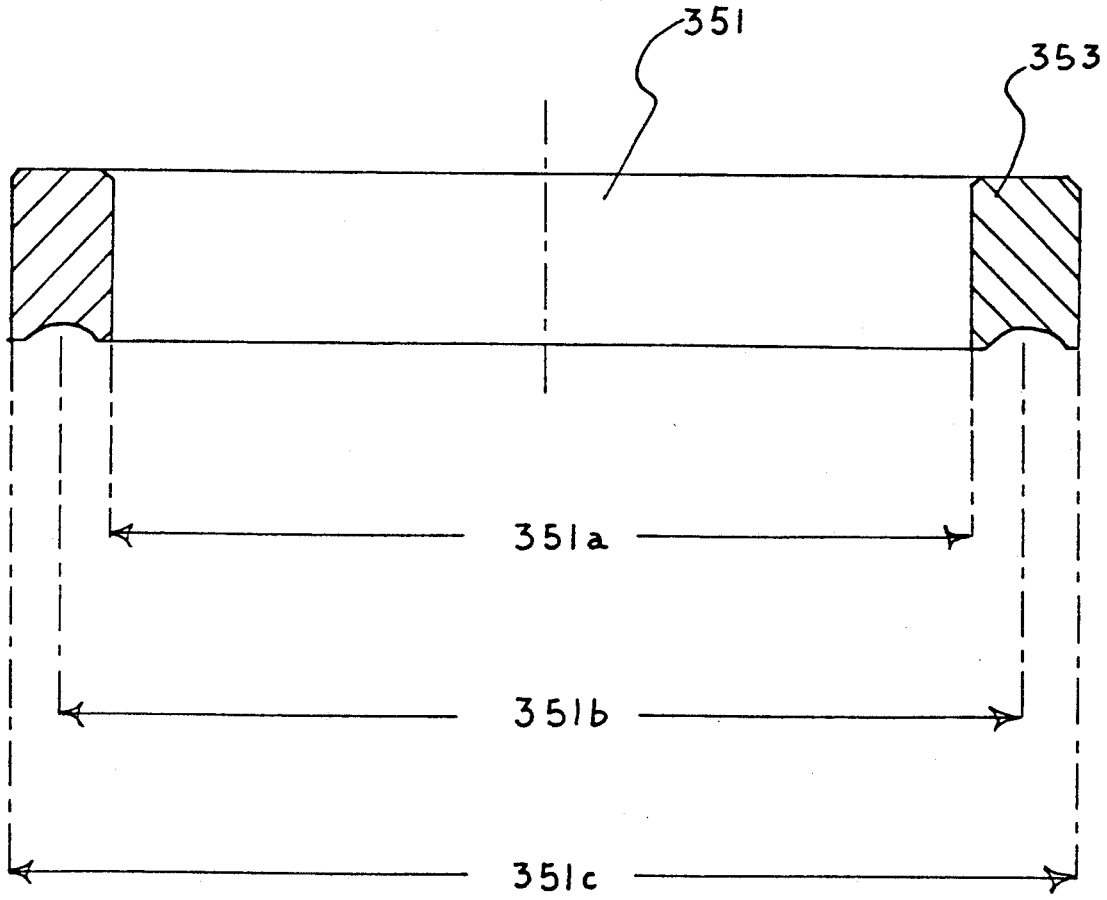
FIG. 13*a* is a full cross-sectional view of an end adapter of the invention.

With reference to FIG. 13*a*, a cross-sectional view of the seal assembly end adapters 303 and 309 is shown as a full diametrical cross-section of a cylindrical ring 351. Cylindrical ring 351 has a radial cross-section 353 which is shaped as shown in FIG. 13*a*. Cylindrical ring 351 has an inside diameter 351*a* ranging from 2.886 inches to a minimum of 2.883 inches, an outside diameter of 351*c* ranging from 3.240 inches to a maximum of 3.245 inches, and a mean diameter 351*c* measured from crotch to crotch of 3.066 inches.

Figure 13B:
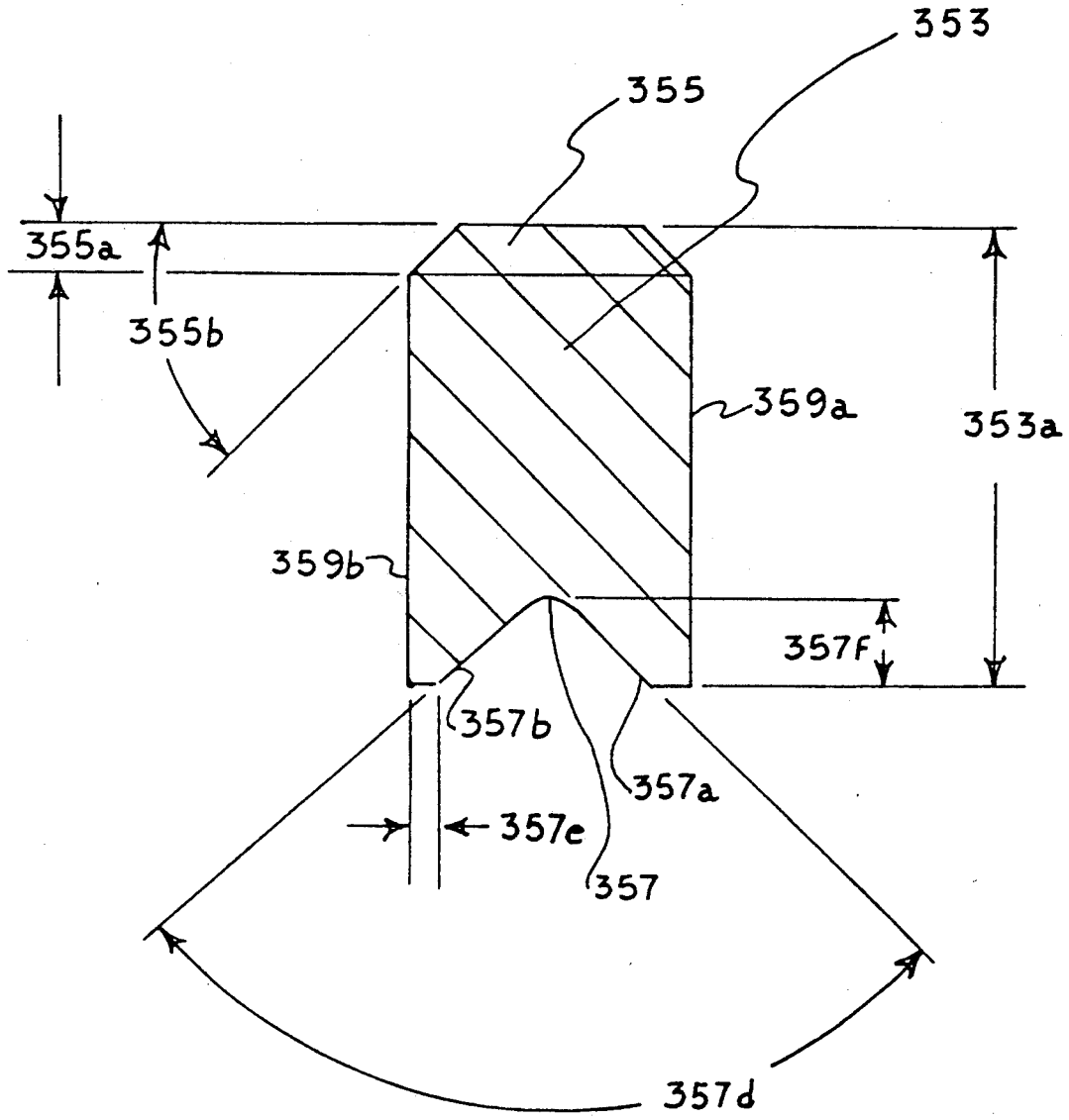
FIG. 13*b* is an enlarged sectional view of a radial cross-section of an end adapter of the invention.

FIG. 13*b* is a detailed view of the radial cross-section 353 of cylindrical ring 351. As shown in FIG. 13*b*, cross-section 353 has an axial end 355 for mating with one of the axial ends of cavity 130, for an example see FIG. 11 where seal assembly and adapter 303 is mating with the upper end of cavity 130. Axial end 355 mates with one of the axial ends of cavity 130 to prevent axial motion of bidirectional seal assembly 301 when pushed upward by wellbore pressure. With reference to FIG. 13*b*, opposite of axial end 355 is axial end 357 which is formed in a generally inwardly protruding shape for mating with a nose 341 of the generally chevron shape 333, for example see FIG. 11 with the first retainer seal ring 311 mated with seal assembly end adapter 303. The axial end 357 of seal assembly end adapter 303 retains first retainer seal ring 311 when pushed upwardly by a wellbore pressure.

Axial end 357 is formed by two radially opposed oppositely inclined surfaces 357*a* and 357*b*, and projections from surfaces 357*a* and 357*b* form an end adapter crotch angle 357*d*, which is measured in a radial direction and is axially opposite from the nose center, and equal to 96°. The end adapter crotch angle 357*d* is the same as nose angle 341*e* of generally chevron shape 333. Axial end 357 has an inner radius which is the same as surface 343*c* of the crotch 343 of general chevron shape 333. Axial surface 357 is made to supportingly engage with a mating nose 341 of general chevron shape 333, as is shown in FIG. 10 with first retainer seal ring 311 mated with end adapter 303.

Radially opposing sides 359*a* and 359*b* do not sealingly engage adjoining sliding sleeve outer surface 111*f*, nor do they sealingly engage housing inner surface 117*f*.

With reference to FIG. 16*b*, seal assembly end adapter cross-section 353 has an axial length 353*a* of 0.270 inches minimum, and a beveled edge with an axial projection 355*a* measuring from 0.020 inches to 0.040 inches, which is inclined at an angle 355*b* equal to 45°, an axial crotch length 357*f* of 0.065 inches, and a crotch flat outer radial surface measuring 0.005 to 0.010 inches.

With reference to 14*a*, seal assembly center adapter 306 is formed in the shape of a cylindrical ring 361 which is shown in full diametrical cross-section. Cylindrical ring 361 has a radial cross-section 363. In the preferred embodiment, cylindrical ring 361 has an inside diameter 361*a* which ranges from 2.883 inches to a minimum of 2.880 inches, and an outer diameter 361*b* which measures in a range from 3.240 inches to a maximum of 3.245 inches.

Figure 14A:
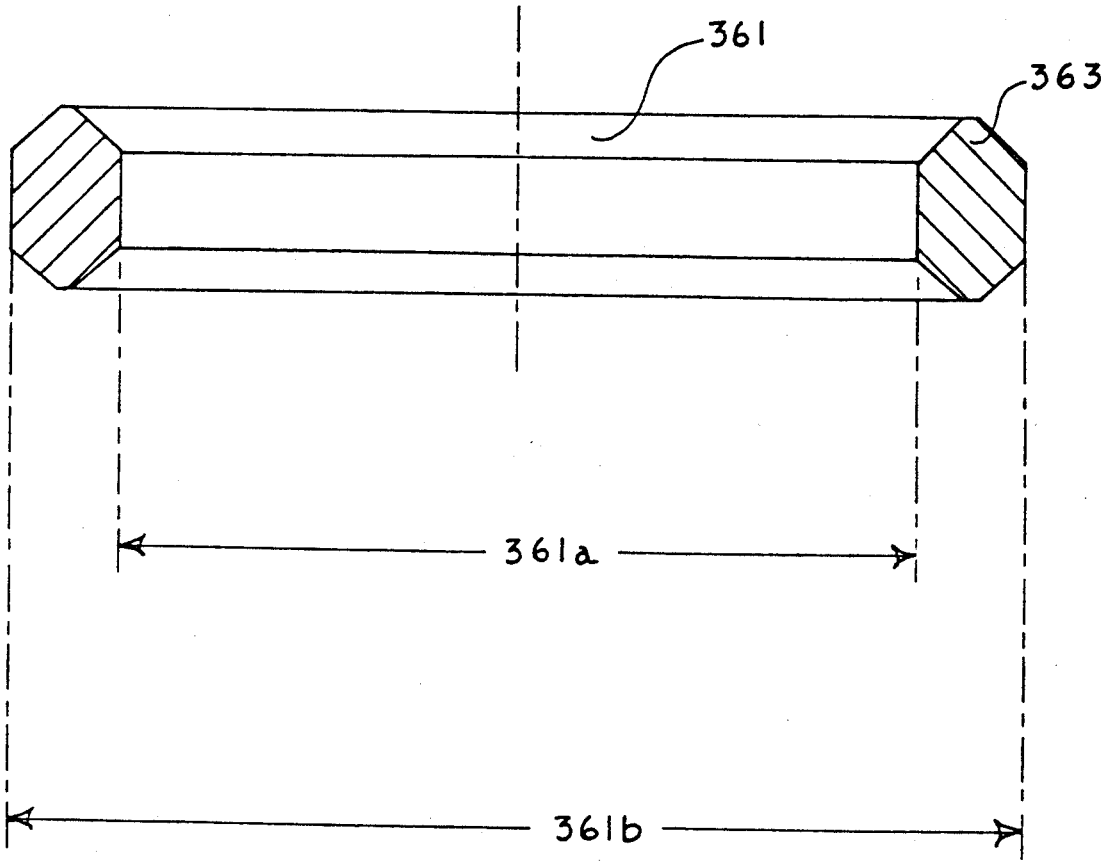
FIG. 14*a* is a full cross-sectional view of a center adapter used in the invention.
Figure 14B:
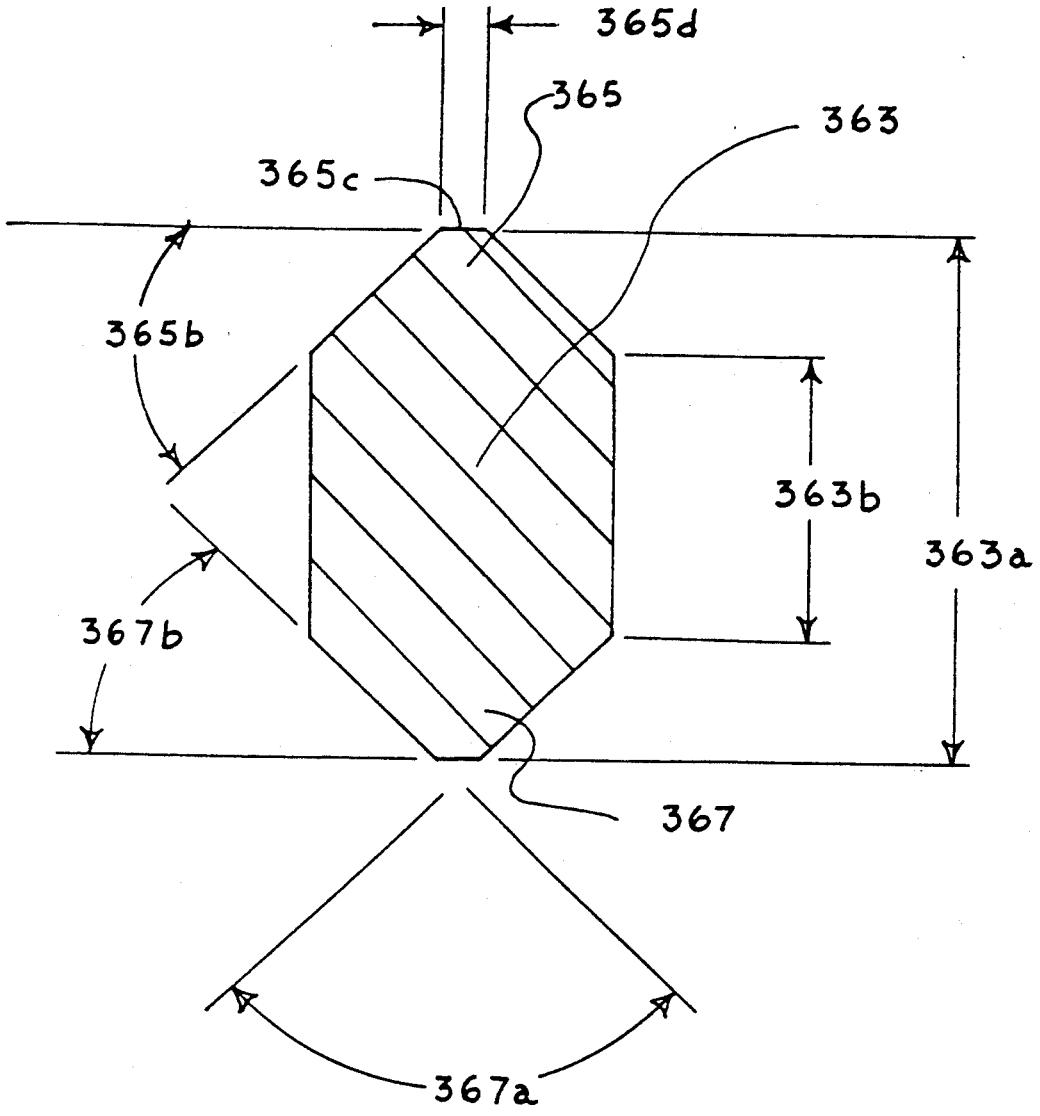
FIG. 14*b* is a radial sectional view of a cross-section of the seal assembly center adapter used in the invention.

FIG. 14*b* is a detailed view of the shape of radial cross-section 363 of cylindrical ring 361. Cross-section 363 has an axial length 363*a* ranging from 0.302 inches to a maximum of 0.305 inches from nose tip to nose tip. Cross-section 363 also has nose shapes 365 and 367 on axially opposite sides. Nose shapes 365 and 367 are both symmetrical around a radially oriented centerline through cross-section 363, and both have the same nose angles as does the nose 341 for generally chevron shape 333 which is shown in FIG. 12*b*.

With reference again to FIG. 14*b*, the nose angle 367*a* between the projection of the two outwardly converging radially opposed oppositely inclined surfaces which form nose 367 measure 96° in the preferred embodiment. Both of the outwardly converging radially opposed oppositely inclined surfaces forming nose 367 are inclined at an angle 365*b* and 367*b* from a radial direction which measures 42°. At the central portion of nose 367 and 365, where the two outwardly converging radially opposed oppositely inclined surfaces forming nose 367 and 365 meet, both have a radially flat surface 365*c* and 367*c* which measure from 0.020 inches to 0.025 inches across as shown by dimension 365*c* for flat surface 365*c*.

With reference to FIG. 11, seal assembly end adapter 306 which has a radial cross-section of shape 363 is utilized to supportingly engage unidirectional seal assemblies 305 and 307. Seal assembly center adapter 306 does not seal fluid flow, but rather it supports the seal rings. FIG. 11 shows the upper nose of seal assembly center adapter 306 engaging the crotch of third retainer seal ring 319. When pressure is applied to cavity 130 from below the bidirectional seal assembly 310, the force of that pressure will push the center seal assembly center adapter 306 upward into the crotch of 319 with an axial interference fit between a seal assembly center adapter nose with a nose angle of 96° and the third retainer seal ring crotch with a crotch angle of 86°. This upward movement and the axial interference fit will flare out the crotch of third retainer seal ring 319 until the sides of retainer seal ring 319 sealingly engage the outer sliding sleeve surface 111*f* and the upper tubular housing member surface 117*f*.

In the preferred embodiment, bidirectional seal assembly 301 is wholly constructed from thermoplastic materials. Thermoplastic seal rings 313, 317, 327, and 323 are constructed from a polytetrafluoroethylene, commonly referred to under the Du-Pont trademark as TEFLON, based composite thermoplastic available from Greene Tweed and Company, P.O. Box 305, Detwiler Road, Kulpsville, Pa., under a tradename of AVALON NO. 89 manufactured by their Advante Division in Garden Grove, Calif. Retainer seal rings 311, 315, 319, 329, 325, and 321 are constructed from polyetherketone, which is available from Green Tweed and Company. Seal assembly center adapter 306 and seal assembly end adapters 303 and 309 are constructed from polyetheretherketone. However, these adapters may also be constructed from another material such as metal.

Also, seal assembly end adapters 303 and 309 could be made as an integral part of cavity 130. While the preferred embodiment is constructed of these materials, it is however anticipated that other materials may be used in different embodiments of this invention.

Since the bidirectional seal assembly 301 of the preferred embodiment is constructed of thermoplastic materials and elastomeric materials are not used, this embodiment of the invention has a much longer service life under applications requiring both exposures to high downhole wellbore temperatures for prolonged periods of time and numerous temperature thermocyclings, than the prior art sealing assemblies which use elastomeric materials. Also, this embodiment of the invention has excellent chemical resistance.

Since the elastomeric materials are not used in this embodiment of the invention, energization of the bidirectional sealing assembly is accomplished without utilization of the elastic memory properties found in the elastomeric materials. Thermoplastics are materials which have very little memory, that is, they don't readily return to shape as elastomeric materials do. That is, they have very little elastic memory.

Energization of this embodiment of the invention, that is, the means by which surfaces of the bidirectional sealing assembly 301 are pushed into sealing engagement with sliding sleeve outer surface 111*f* and cylindrical housing surface 117*f*, is accomplished by utilizing two types of interference fits in combination with the wellbore pressure which the bidirectional sealing assembly 301 is used to seal against. These two interference fits are a diametrical interference fit, which is defined by the difference in diametrical cross-section between the seal rings diametrical cross-section and the diametrical cross-section between sliding sleeve outer surface 111*f* and cylindrical housing inner surface 117*f*, and an axial interference fit which is the nose to crotch interference fit discussed above. The diametrical interference fit occurs when a retainer seal ring of the dimensions of cylindrical ring 331, as discussed above and shown in FIG. 14*a*, is inserted between sliding sleeve outer surface 111*f* which measures from 2.875 inches to 2.878 inches, and cylindrical housing inner surface 117*f* which measures from 3.250 inches to 3.253 inches.

With reference to FIG. 11, pressure coming from the bottom of cavity 130 will be pushing upward on retainer seal ring 319 which both flares the wing surfaces of retainer seal ring 319 outward and forces retainer seal ring 319 up into the crotch of thermoplastic ring 317. This in turn flares the wing surfaces of thermoplastic seal ring 317 outward into sealing engagement. The nose of thermoplastic seal ring 317 in turn presses into the crotch of retainer seal ring 315 to flare it outward which presses the outer wing surfaces of retainer seal ring 315 into sealing engagement with outer surfaces 111*f* and 117*f*. In this way, pressure is utilized in combination with the axial interference fit to force a sealing engagement. The diametrical interference fit encourages sealing engagement between the winged outer surfaces of retainer seal rings and thermoplastic seal rings so that they will seal at lower wellbore pressures.

The bidirectional seal assembly 301 seals flow in two axial directions. With reference FIG. 11, bidirectional sealing assembly 301 is comprised of unidirectional sealing stacks 305 and 307 which each seal fluid flow in one axial direction only. These unidirectional seal ring stacks are each comprised of two thermoplastic seal rings which are nested between adjacent retainer seal rings. Each unidirectional seal ring stack has an axial end, which mates with the adjacent center adapter 306. That unidirectional seal ring stack end is defined as the active end, or active axial end, of each corresponding unidirectional seal ring stack. The opposite axial end, which mates with either of seal assembly end adapters 303 or 309, is defined as the passive end, or passive axial end, of that corresponding unidirectional seal ring stack. The active axial end of each unidirectional seal ring stack faces the direction of axial flow that unidirectional ring will seal against. For example, with reference to FIG. 11, the active axial end of unidirectional seal ring stack 305 is defined by the crotch of third retainer seal ring 319. Unidirectional seal ring stack 305 will seal against an axial wellbore fluid flow which originates from the lower end of cavity 130 and is flowing towards unidirectional stack 305. Unidirectional seal stack 307 will seal against wellbore fluid flow which flows from seal assembly end adapter 303 towards seal assembly center adapter 306. The active axial end of unidirectional seal ring stack 307 is the crotch of retainer seal ring 329.

Figure 16:
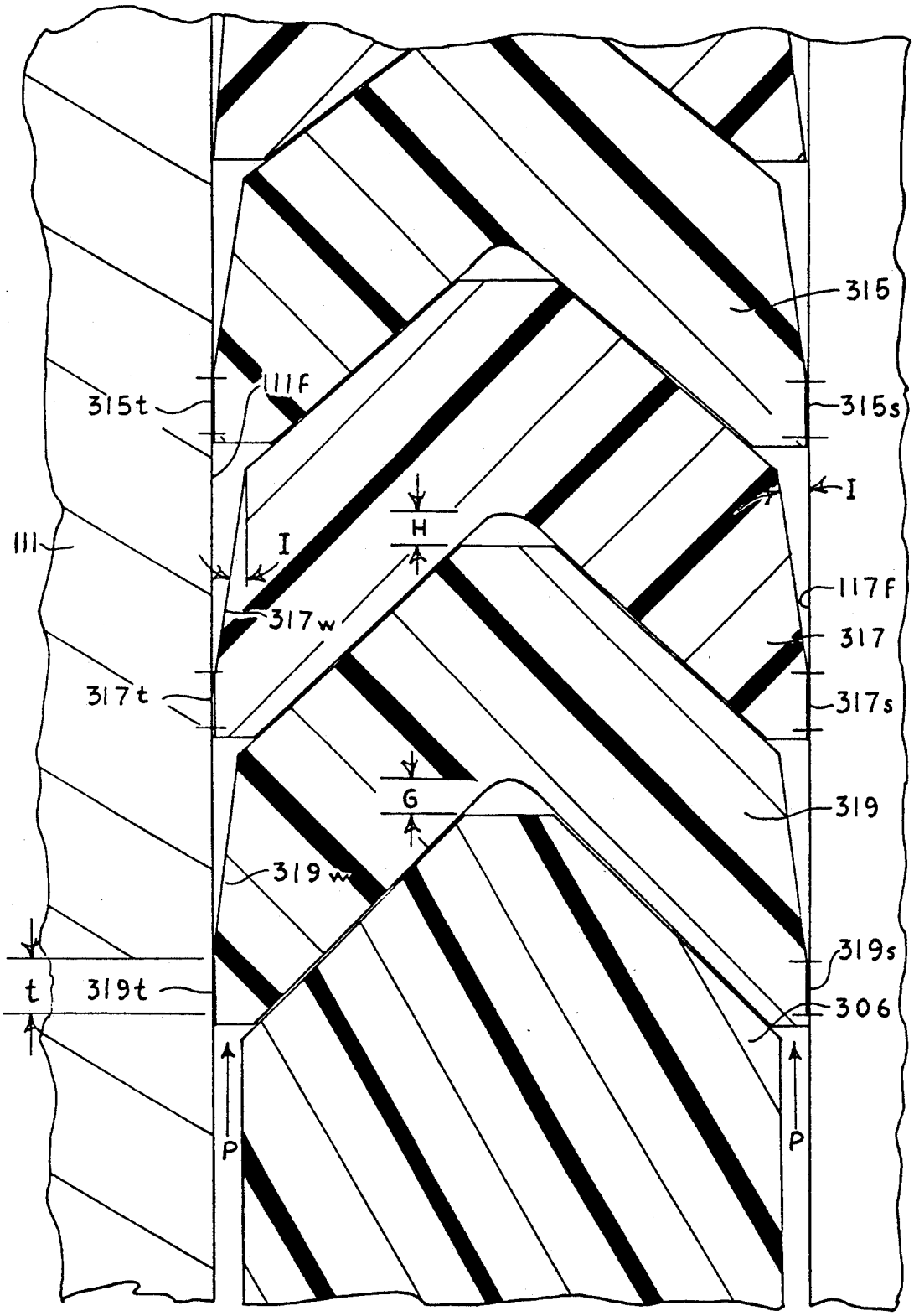
FIG. 16 is an enlarged cross-sectional view of the sealing apparatus showing Detail A of FIG. 11.

With reference to FIG. 16, a wellbore pressure P is shown which urges a wellbore fluid to flow from the bottom of cavity 130 to the top of cavity 130. This wellbore pressure P exerts a pressure against the active axial end of unidirectional seal ring stack 305, which is the crotch and radially outer end of the lower portion of third retainer seal ring 319. The nose of third retainer seal ring 319 is pressed into the crotch of second thermoplastic seal ring 317 in response to the forces acting on the crotch of third retainer seal ring 319.

In this preferred embodiment of this invention, at high wellbore temperatures, which are in excess of 270° F., the thermoplastic material from which thermoplastic seal ring 317 is made is rather soft and pliable. This thermoplastic material has enough resistance to flowing to somewhat maintain its shape, yet under higher forces it will deform and extrude. Second retainer 315 and third retainer 319 are on alternating radial sides of second thermoplastic seal ring 317. Since they are both formed in the general chevron shape of thermoplastic seal ring 317, and in combination with thermoplastic seal ring 317 being made from a thermoplastic material still somewhat resistant to flowing at this temperature, the general chevron shape of thermoplastic seal ring 317 will be maintained.

Although thermoplastic seal ring 317 may shrink in size if it undergoes numerous thermocycles from which its temperature is varied from a high temperature to a lower temperature, the general shape will be maintained. The shape of thermoplastic seal ring 317 is maintained since retainer seal ring 315 and 319 buttress the shape of seal ring 317, and also third retainer seal ring 319 seals against wellbore pressure being applied to seal ring 317. With the proper selection of thermoplastic material from which to make thermoplastic seal ring 317, and with a nose to crotch interference fit angle of less than 20°, thermoplastic seal ring 317 will not be extruded when pressed between the adjoining retainer seal rings 319 and 315, and also when port 116 passes over the seal assembly. After numerous thermocyclings, thermoplastic seal ring 317 may shrink some with plastic deformation yet the general shape will be maintained. Thermoplastic seal ring 317 is not extruded since it is sealed from well bore pressure by third retainer seal ring 319.

Sealing engagement between the bidirectional seal assembly 301, sliding sleeve outer surface 111*f*, and cylindrical housing inner surface 117*f* is encouraged by wellbore pressure acting upon the nose to crotch interference fit between the nose and crotch of adjacent seal rings. For example, with reference to FIG. 16, the nose of seal assembly center adapter 306 is pressed into the crotch of retainer seal ring 319 and causes the crotch of retainer seal ring 319 to be flared out to a somewhat slightly larger diametrical dimension. When the crotch of retainer seal ring 319 is flared out, cylindrical surfaces 319*t* and 319*s* are encouraged to sealingly engage surfaces 111*f* and 117*f* respectfully. In turn, third retainer seal ring 319 press the nose of third retainer seal ring 319 into the crotch of second thermoplastic seal ring 317 and cause it to be diametrically flared to slightly larger diametrical dimension. The flaring of the crotch of thermoplastic seal ring 317 encourages cylindrical sealing surfaces 317*t* and 317*s* to be urged to sealingly engaged surfaces 111*f* and 117*f*. If wellbore temperatures are below a high level of temperature, thermoplastic seal ring 317 will be pliable, or soft enough, so that it fills scratches and voids that may be in either 317*f* or 111*f* so that cavity 130 will be sealed against wellbore fluid flow. At higher wellbore temperatures, which are above 270° for the preferred embodiment, the high temperature thermoplastic material from which retainer seal ring 319 is constructed will be pliable enough to fill voids or scratches that may be in either of surface 111*f* or 117*f*, and thus sealingly engage both sealing surfaces 111*f* and 117*f*.

Figure 15A:
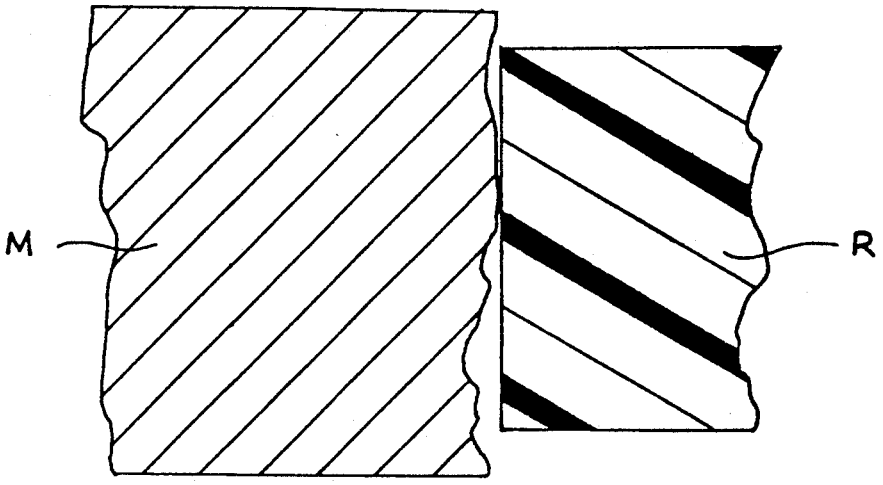
FIG. 15*a* is a cross-sectional view of a rigid plastic member mating with a metal member.
Figure 15B:
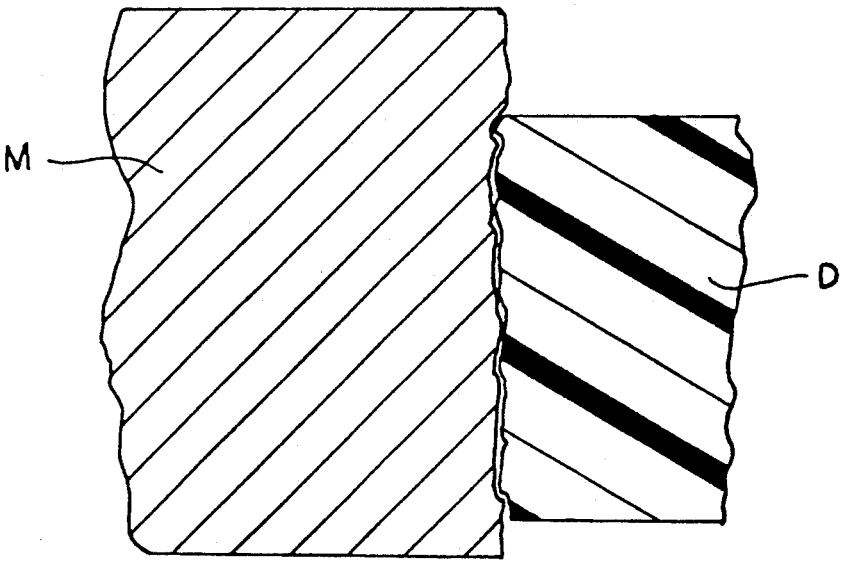
FIG. 15*b* is a cross-sectional view of a pliable plastic member mating with a metal member.

Below high well bore temperatures, although surfaces 319*t* and 319*s* are pressed into engagement with surfaces 111*f* and 117*f*, there is no assurance that they will seal the voids and scratches that may be in either of surfaces 111*f* and 117*f* since the high temperature thermoplastic material of which retainer seal ring 319 is constructed is more rigid and less pliable than it is at high wellbore temperatures, and thus it may not flow to fill such voids. For example, see FIG. 15*a* showing a rigid thermoplastic surface which is so rigid that it will not deform, or extrude, to conform to shape of a mating metal surface M. Compare FIG. 15*a* to FIG. 15*b* which shows a pliable thermoplastic surface D which deforms to fill voids and scratches in the metal surface, or conforms to the shape of the mating metal surface M. However, with reference to FIG. 11, if the surfaces 111*f* and 117*f* are highly polished, that is if they are without voids and scratches, surfaces 319*t* and 319*s* of retainer seal member 319 may possibly seal at lower well bore temperatures.

In order to maintain the usefulness of the nose to crotch interference fit after thermoplastic seal rings have been exposed to higher wellbore temperatures where they are subject to permanent plastic deformation, there is a clearance between the tip of a nose 341*c* and the center of a crotch 343*c* to leave an axial clearance, or gap labeled as "G" in FIG. 16. "G" is shown as the axial length between the nose of seal assembly center adapter 306 and the crotch of third retainer seal ring 319. Also shown in clearance "H" between the nose of third retainer seal ring 319 and the crotch of second thermoplastic seal ring 317. Although second thermoplastic seal ring 317 may flow and be permanently deformed at a higher wellbore temperature, in the preferred embodiment it is resilient enough that there will not be much plastic deformation and clearance "H" will not be maintained. There will be enough of a gap for retainer seal ring 319 to press into and flare out the crotch of thermoplastic seal ring 317 so that the surfaces 317*s* and 317*t* will be urged into sealing engagement with the adjacent surfaces of 111*f* and 117*f*. In fact, testing has shown that even though thermoplastic seal rings such as 317 may shrink to where they do not have an interference fit between mating surfaces 111*f* and 117*f* after numerous thermocyclings up to higher wellbore temperatures, the shape of thermoplastic seal rings has been maintained by adjacent retainer seal rings so that the thermoplastic seal rings will still sealingly engage adjacent surfaces 111*f* and 117*f*.

In addition to the nose to crotch interference fit, there is also a diametrical interference fit when unidirectional seal stack 305 and unidirectional seal stack 307 are located between surfaces 111*f* and 117*f*. This diametrical interference fit encourages sealing engagement of third retainer seal ring surfaces 319*t* and 319*s* with 111*f* and 117*f*.

One of the important features of this invention is that it sealingly engages a surface which moves relative to the bidirectional sealing apparatus. In a preferred embodiment, wing surface inclination angles 345*b* and 347*b*, which are shown in FIG. 12*b*, provide a reduced sealing surface area which contacts the surface which moves relative to the bidirectional seal assembly. For example with reference to FIG. 11, cylindrical shifting sleeve 111 moves in relation to the bidirectional seal assembly 301. As shown in FIG. 16 all of the radially innermost interior wing surface 347*a* will not fully engage sliding sleeve outer surface 111*f*. Instead, with reference to third retainer seal ring 319, only surface 319*t* will sealing engage 111*f* not surface 319*w*. The same occurs with second thermoplastic seal ring 317, wherein only surface 317*t* engages surface 111*f* and not the much larger surface area 317*w*. This is true of the rest of the retainer seal rings and thermoplastic seal rings. This reduced point of contact surface area is mated in dynamic sealing engagement with sliding sleeve outer surface 111*f* without inducing excessive frictional forces which would cause either impairment of the bidirectional sealing assembly or constrict motion of cylindrical shifting sleeve 111. Wing surfaces 317*t* and 310*t* are dynamic engagement wing surfaces since they are in dynamic engagement with sleeve 111 which moves relative to surfaces 317*t* and 319*t*.

Note that cross-sections of retainer seal ring 319 will show surfaces 317*w* and 319*w* as either of surfaces 345*a* or 347*a* of the generally chevron shape shown in FIG. 12*b*.

Chevron wing sealing surface inclination angle I is measured between an axial direction, which is the direction axially extending circumferential surfaces 111*f* and 117*f* extend, and the exterior wing surface 319*w* and 317*w* as shown on the left side of FIG. 16. The inclination angle I, which is 3° in the preferred embodiment, allows sealing surfaces 317*t*, 317*s*, 319*t* and 319*s* to extend in a shorter axial direction t shown for 319*t* in FIG. 16, than they would if the whole side 317*w* and 319*w* were parallel to 111*f*, which would give an inclination angle I of 0°. This reduced axially extending mating sealing surface results in a reduced frictional engagement between mating sealing surfaces, and thus sliding sleeve 111 is still movable in relation to bidirectional seal assembly 301 and a well bore tool housing consisting of tubular member 301 and ported housing 103.

The first retainer seal ring 311 and first thermoplastic seal ring 313 are merely for redundancy, used as a backup in case there is a failure of one of the forward seal rings.

Another embodiment of this invention, would be to use it in a sealing assembly which is used to seal production tubing into a seating assembly in a permanently set packer in a wellbore. A sealing assembly of similar configuration as the bidirectional seal assembly 301 discussed above could be utilized. Another application for this invention would be for sealingly engaging a lock into a nipple in production tubing. A lock is a device which may be run into production tubing to seal a nipple which is a cylindrical surface of a smaller diameter than the internal diameter of the production tubing in which the lock seats to seal off a section of the tubing string. The present invention could also be used to seal other devices which seat inside of a tubing nipple, or anywhere else where prior art Chevron shape seals have been used before.

The present invention is particularly useful for sealing a tubing sealing assembly inside of a packer seating assembly, or for sealing a lock inside of a nipple, since both involve sealing noncontinuously mating relatively moveable surfaces. Here, the mating is noncontinuous because the surfaces engage and disengage, as opposed to the ported member being noncontinuous because of the port in the ported member moving across a mating surface.

The sealing apparatus disclosed accomplishes the objectives of sealingly engaging a noncontinuously mating movable metal member using only thermoplastic materials. Since only thermoplastic materials are used, the seal assembly is much more durable than if elastomeric materials were used. It may be exposed to higher temperatures for much long durations of time. Tests have shown and proved that ported sleeves sealingly engaged by this apparatus may be actuated up to 25 cycles, 50 axial movements, as opposed as to 1–5 with prior art sealing members. This invention greatly extends the life of well bore tools which require sealing of noncontinuously mating and repeatably moveable members. Thermoplastic materials have an almost indefinite life at higher temperatures, whereas elastomeric materials will become hard and brittle after prolonged exposure to high temperatures so that they will not seal a movable sleeve after its actuated.

Therefore, the sealing apparatus of this disclosure accomplishes the objectives listed above. The preferred embodiment of this invention is a sealing apparatus constructed of thermoplastic materials for use in dynamic sealing engagement between two moveable members. Since only thermoplastic materials are used, the sealing assembly will provide a dynamic sealing engagement after prolonged exposure to high wellbore temperatures which would cause prior art sealing assemblies made of elastomeric materials not to perform. Thermoplastics also resist gouging and scratching a lot better than elastomeric materials.

Comparison tests between the preferred embodiment of this invention and in similar prior art sealing assemblies have shown the advantages of this invention. Prior art sealing assemblies have only lasted for as long as five cycles, comprised of two axial movements before they no longer sealed; however, the preferred embodiment of this invention has been tested up to twenty-five cycles, which is fifty axial movements, while retaining a reliable sealing engagement. Where the prior art sealing assemblies were no longer functional, the preferred embodiment of this sealing assembly still keeps on going. This invention will be greatly useful for both extending life of wellbore tools utilizing moveable members, and to provide a reliable seal for wellbore surfaces which need to be mated under wellbore temperatures and pressures. Elastomeric material will become hard, brittle, and lose their memory so that they will not sealingly engage after prolonged exposure to wellbore temperatures, the preferred embodiment of this invention will still be able to perform.

While the invention has been particularly shown and described as referenced in the preferred embodiment, it will be understood by those skilled in the art that various changes in the form and detail may be made therein without departing from the spirit and scope of the invention.

We claim:

1. A sealing apparatus for use in a wellbore to seal a space between a first surface and a second surface to prevent a wellbore fluid flow therethrough, wherein said second surface is moveable relative to said first surface, said sealing apparatus comprising:

a seal assembly which includes:

at least one thermoplastic seal member formed from a thermoplastic material which is pliable at a first wellbore temperature, said at least one thermoplastic seal member sealingly engaging said first surface and said second surface to prevent said wellbore fluid flow at a second temperature which is lower than said first temperature;

a plurality of retainer seal members formed from a high temperature thermoplastic material, said plurality of retainer seal members engaging said first surface and said second surface at said first wellbore temperature in a sealing engagement which seals said space against said wellbore fluid flow and seals said space against extrusion of said at least one thermoplastic seal member;

wherein said plurality of retainer seal members are disposed adjacent to opposing sides of said at least one thermoplastic seal member to retain said at least one thermoplastic seal member in a selected shape at said first wellbore temperature so that upon cooling to said temperature lower than said first wellbore temperature, said at least one thermoplastic seal member will be shaped to sealingly engage said first surface and said second surface to prevent said wellbore fluid flow; and at least one retention member which supportively retains said at least one seal assembly to prevent axial movement of said seal assembly relative to said first surface.

2. The sealing apparatus of claim 1, wherein:

said sealing assembly is urged to sealingly engage said first and second surface at said first temperature by action of both an interference fit of said plurality of retainer seal members between said first surface and said second surface, and a wellbore pressure which urges said wellbore fluid flow; and said sealing assembly is urged to sealingly engage said first and second surfaces at said temperature lower than said first temperature by action of both an interference fit between said at least one thermoplastic seal member and said plurality of retainer seal members, and said wellbore pressure which urges said wellbore fluid flow.

3. The sealing apparatus of claim 1, wherein said seal assembly sealingly engages said first surface and said second surface:

after exposure to numerous thermocycles of being heated to said first wellbore temperature and then cooled to said temperature lower than said first temperature; and after prolonged exposure to said first wellbore temperature and after numerous repeated movements of said second surface relative to said first surface and said sealing assembly.

4. The sealing apparatus of claim 1 wherein:

said thermoplastic material is polytetrafluoroethylene based composure thermoplastic; and said high temperature thermoplastic material is polyetherketone.

5. The sealing apparatus of claim 1, wherein:

said at least one thermoplastic seal member has a cross-section including opposing sides of a generally inwardly protruding shape and a generally outwardly protruding shape;

said plurality of retainer seal members have a retainer cross-section including opposing sides of a retainer generally inwardly protruding shape and a retainer generally outwardly protruding shape; and said retainer generally outwardly protruding shape has an interference fit with said generally inwardly protruding shape wherein said retainer generally outwardly protruding shape when forcibly mated with said generally inwardly protruding shape will urge an expansion of said generally inwardly protruding shape.

6. The sealing apparatus of claim 5, wherein:

said first surface comprises a first cylindrical surface; and said second surface comprises a second cylindrical surface concentric with said first surface;

said at least one thermoplastic seal member is formed in a shape of a cylindrical ring having a cross-section including axially opposing sides of a generally inwardly protruding shape and a generally outwardly protruding shape;

said plurality of retainer seal members are formed in a shape of a second cylindrical ring having a retainer cross-section including axially opposing sides of a retainer generally inwardly protruding shape and a retainer generally outwardly protruding shape; and said retainer cross-section includes said retainer generally outwardly protruding shape having an interference fit with said generally inwardly protruding shape of said cross-section, wherein said retainer generally outwardly protruding shape when forcibly mated with said generally inwardly protruding shape will urge an expansion of said generally inwardly protruding shape.

7. The sealing apparatus of claim 1, wherein:

said at least one thermoplastic seal member defines a substantially chevron shape in radial cross-section view.

8. The sealing apparatus of claim 1, wherein:

said at least one thermoplastic seal member is shaped as a circumferentially continuous cylindrical ring of a generally chevron shape in radial cross-section; and said plurality of retainer seal members are each shaped as said circumferentially continuous ring of a generally chevron shape in radial cross-section.

9. A seal member for use in a sealing apparatus which is used in a wellbore tool to sealingly engage a moveable surface of a noncontinuously mating moveable member to prevent a flow of a wellbore fluid along said moveable surface of said noncontinuously mating moveable member, said seal member comprising:

a dynamic engagement wing defining a portion of said seal member which is disposed to engage said noncontinuously mating moveable member, said dynamic engagement wing at least in part defined by:

an active end surface which faces said flow of said wellbore fluid;

a passive end surface which is oppositely disposed across said outer wing from said active end surface;

a dynamic engagement wing surface which includes a sealing surface which sealingly engages said noncontinuously mating moveable member;

wherein said active end surface which faces said flow of said wellbore fluid at least in part being defined by:

an inwardly protruding surface which is shaped to provide a sealing energization so that when said inwardly protruding surface is pressed by said wellbore fluid said sealing surface is pushed into sealing engagement with said moveable surface of said noncontinuously mating moveable member; and a blunt wing surface which is disposed intermediate of said active end surface and said dynamic engagement wing surface, and which is sized to provide a balance in a rigidity of said dynamic engagement wing which is stiff to prevent displacement of said dynamic engagement wing into a path of said moveable surface of said noncontinuously mating moveable member, and flexible to allow said sealing energization of said wellbore fluid pushing said sealing surface into sealing engagement.

10. The seal member of claim 9, wherein the moveable surface of said noncontinuously mating moveable member is defined by a cylindrical shape, and said seal member further comprising:

a cylindrical ring having a radial cross-section of a generally chevron shape which includes:

a crotch which is defined by a generally inwardly protruding chevron surface, a portion of which defines said inwardly protruding surface of said active end surface of said dynamic engagement wing;

a nose which is defined by a generally outwardly protruding chevron surface, a portion of which defines said passive end surface of said dynamic engagement wing;

said dynamic engagement wing surface disposed from said moveable surface at a sealing surface inclination angle, and defining said sealing surface; and said blunt wing surface defined by a flat radial surface.

11. The seal member of claim 10, wherein said noncontinuously mating moveable member comprises:

a ported moveable member, which includes said moveable surface which said seal member sealingly engages;

said moveable surface includes at least one port therethrough, and wherein mating is noncontinuous between said moveable surface and said seal member when said at least one port passes by said seal member; and said path of said moveable surface at least in part defined by a trailing edge of said at least one port through said moveable surface.

12. The seal member of claim 10, wherein said noncontinuously mating moveable member further comprises a housing which is disposed in a production tubing string disposed within said wellbore, and said housing includes an inner cylindrical nipple surface which defines said moveable surface which is sealingly engaged by said seal member when said seal member is moved into said housing.

13. The apparatus of claim 10, wherein said noncontinuously mating moveable member comprises a seating assembly inside of a wellbore packer, and wherein said seal member comprises a sealing assembly stem which sealingly engages said moveable surface when said sealing assembly stem is lowered inside of said seating assembly.

14. The apparatus of claim 10, wherein said seal member is comprised of thermoplastic.

15. A seal assembly for use in a wellbore to sealingly engage a moveable surface in a noncontinuously mating engagement in which said moveable surface includes an edge which is moved across said seal assembly, said seal assembly comprising:

a thermoplastic seal member having a wing portion extending therefrom for sealingly engaging said moveable surface to prevent a fluid flow therebetween;

a means for pressing said thermoplastic seal member into sealingly engaging said moveable surface to prevent said fluid flow therebetween;

a retainer means for supporting said thermoplastic seal member against said means for pressing; and said wing portion of said thermoplastic seal member having an end thickness for providing sufficient rigidity to prevent said means for pressing from urging said wing portion substantially into a path of said edge of said moveable member, and thus preventing said edge from damaging said thermoplastic seal member.

16. The seal assembly of claim 15 further comprising:

said retainer means including first and second retainer members, each having a wing portion extending therefrom for sealingly engaging said moveable surface for preventing said fluid flow when said thermoplastic seal member is heated to a temperature at which said thermoplastic seal member substantially softens to a pliability at which said end thickness would not prevent said means for pressing from urging said part of said wing portion substantially into said path of said edge of said moveable member; and said theremoplastic seal member disposed between said first and second retainer members, to protect said thermoplastic seal member from damage when heated to said temperature so that said thermoplastic seal member later sealingly engages said moveable surface when cooled to a lower temperature at which said end thickness of thermoplastic seal member prevents said means for pressing from urging said wing portion substantially into said path of said edge of said movable member.

17. The seal assembly of claim 10, wherein said first and second retainer members are formed from a high temperature thermoplastic.

18. The seal assembly of claim 16, wherein said first and second retainer members together retain said thermoplastic seal member in substantially an initial shape for sealingly engaging said moveable surface to prevent said fluid flow after cooling below said temperature.

19. The seal assembly of claim 15, wherein said thermoplastic seal member sealingly engages said moveable surface to prevent said fluid flow in a first direction only, and said seal assembly further comprises:

a second thermoplastic seal member and second retainer means which prevent said fluid flow in a second direction, which is opposite of said first direction.

20. A thermoplastic seal assembly for sealingly engaging a surface having an edge which said thermoplastic seal assembly moves across while urged to sealingly engage said surface, said thermoplastic seal assembly comprising:

a thermoplastic seal member having a wing portion extending therefrom for sealingly engaging said moveable surface to prevent a fluid flow therethrough;

a means for pressing said thermoplastic seal member into said surface for sealingly engaging said surface to prevent said fluid flow therethrough;

a pair of thermoplastic retainer members, with at least one of said pair of retainer members disposed on each of two opposing sides of said thermoplastic seal member for holding an initial shape of said thermoplastic seal member against said means for pressing; and wherein said thermoplastic seal member, disposed between said pair of thermoplastic retainer members, includes an end thickness for preventing said means for pressing from urging said thermoplastic seal member substantially beyond said edge of said surface to prevent damage to said thermoplastic seal member when passing across said edge.

21. The thermoplastic seal assembly of claim 20, wherein said pair of thermoplastic retainer members are formed from a high temperature thermoplastic for sealingly engaging said surface at a temperature, above which said thermoplastic seal member softens so that said end thickness does not prevent said means for pressing from urging said thermoplastic seal member to extend beyond said edge of said surface.

22. The thermoplastic seal assembly of claim 20, wherein said thermoplastic seal member sealingly engages said surface for preventing said fluid flow in a first direction only, and said thermoplastic seal assembly further comprises:

at least one more thermoplastic seal member which is substantially the same as said thermoplastic seal member for said means for pressing to urge into sealingly engaging said surface to prevent said fluid flow in a second direction, which is opposite of said first direction; and at least one more thermoplastic retainer member for securing each of said at least one more thermoplastic seal members between at least two thermoplastic retainer members for holding an initial shape of each of said thermoplastic seal members against said means for pressing.

23. The thermoplastic seal assembly of claim 20, wherein said thermoplastic seal member is at least in part formed from polytetrafluroethylene; and wherein said pair of thermoplastic retainer members are at least in part formed from polyetherketone.

24. A sealing assembly for use in a wellbore tool to seal an annular space between a first and second surfaces to prevent a wellbore fluid flow therethrough, wherein said first and second surfaces are concentrically disposed and each have a generally cylindrical shape and are axially moveable with respect to each other in a noncontinuously mating engagement, said sealing assembly comprising:

at least one thermoplastic seal ring formed from a thermoplastic material which is pliable at a high wellbore temperature, said at least one thermoplastic seal ring sealingly engaging between said first and second surfaces for preventing said wellbore fluid flow through said annular space at a temperature lower than said high wellbore temperature, said at least one thermoplastic seal ring being formed in a shape with a cross-section including opposing sides of a generally inwardly protruding shape and a generally outwardly protruding shape;

a plurality of retainer seal rings formed from a high temperature thermoplastic material, said plurality of retainer seal rings sealingly engaging between said first and second members for preventing both said wellbore fluid flow though said annular space and extrusion of said at least one thermoplastic seal ring at said high temperature, said plurality of retainer seal rings formed in a shape with said cross-section including opposing sides of said generally inwardly protruding shape and said generally outwardly protruding shape, wherein said generally outwardly protruding shape has a mating engagement with said generally inwardly protruding shape, with said mating engagement having an interference fit wherein said generally outwardly protruding shape when forcibly in said mating engagement with said generally inwardly protruding shape will urge an expansion of said generally inwardly protruding shape;

wherein said at least one thermoplastic seal ring and said plurality of retainer seal rings are secured to said first member for sealingly engaging said second member and moving past an edge of said second member; and wherein one of said plurality of retainer seal rings is disposed adjacent to and in said mating engagement with each axial end of each of said at least one thermoplastic seal ring for retaining said shape of said at least one thermoplastic seal ring at said high wellbore temperatures so that said at least one thermoplastic seal ring will, upon cooling to said temperature lower than said high wellbore temperature, sealingly engage between said first and second surfaces for preventing said wellbore fluid flow.

25. The sealing assembly of claim 24, wherein said sealing assembly is urged to sealingly engage between said first and second surfaces at said high temperatures by action of both a diametrical interference fit of said plurality of retainer seal rings between said first and second surfaces, and a wellbore pressure which urges said wellbore fluid flow.

26. The sealing assembly of claim 24, wherein said sealing assembly urged to sealingly engage said housing and said moveable member at said temperature lower than said high temperatures by action of both an axial interference fit between said at least one thermoplastic seal ring and said plurality of retainer seal rings, and said wellbore pressure which urges said wellbore fluid flow.

27. The sealing assembly of claim 24, wherein at least one thermoplastic ring and said plurality of retainer seal rings define a generally chevron shape in radial cross-section.

28. The sealing apparatus of claim 27, wherein said generally chevron shape includes:

a nose formed by two outwardly protruding surfaces converging at a nose angle;

a crotch formed by two inwardly protruding surfaces converging at a crotch angle;

a nose formed at a nose angle which is less than 20 degrees greater than a crotch angle of said generally chevron shape define said axial interference fit;

said axial interference fit defined by the amount said nose angle is greater than said crotch angle; and at least one chevron sealing surface disposed at a friction reducing inclination angle from a dynamic sealing surface of said moveable member.

29. The sealing apparatus of claim 28, with said generally chevron shape further including:

said nose formed with said nose angle equal to 96 degrees and said crotch formed with said crotch angle equal to 86 degrees to define said axial interference fit; and said at least one chevron sealing surface disposed from said dynamic sealing surface at said friction reducing inclination angle of 3 degrees.

30. The sealing apparatus of claim 24, wherein said thermoplastic material is comprised of polytetrafluroethylene thermoplastic, and said high temperature thermoplastic material comprised of polyetherketone.

31. The sealing apparatus of claim 24, wherein said sealing assembly sealingly engages between said first and second surfaces after exposure to numerous thermocycles of being heated to said high wellbore temperature and then cooled to said lower temperature, prolonged exposure to said high wellbore temperature, and after numerous repeated movements of said edge across said seal assembly with pressure urging wellbore fluid flow.

* * * * *